US011470983B1

(12) United States Patent
Flannery et al.

(10) Patent No.: US 11,470,983 B1
(45) **Date of Patent: *Oct. 18, 2022**

(54) SWIVEL ROCKER WITH ROLL AND PITCH MOTION

(71) Applicant: Regalo International, LLC, Longboat Key, FL (US)

(72) Inventors: Mark A. Flannery, Longboat Key, FL (US); Caleb Summers, Minneapolis, MN (US); Brian M. McMahon, Palatine, IL (US)

(73) Assignee: Regalo International, LLC, Longboat Key, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/019,246

(22) Filed: Sep. 12, 2020

Related U.S. Application Data

(63) Continuation of application No. 15/608,522, filed on May 30, 2017, now Pat. No. 10,779,659.

(60) Provisional application No. 62/343,838, filed on May 31, 2016.

(51) Int. Cl.
*A47D 9/04* (2006.01)
*A47D 9/00* (2006.01)

(52) U.S. Cl.
CPC ..... *A47D 9/04* (2013.01); *A47D 9/005* (2013.01)

(58) Field of Classification Search
CPC ..... A47D 9/04; A47D 9/005; A47D 13/10; A47D 13/105; A47D 9/02; A45F 3/22; A47C 21/006
See application file for complete search history.

(56) References Cited

U.S. PATENT DOCUMENTS

| | | | | |
|---|---|---|---|---|
| 2,587,255 | A * | 2/1952 | Vogel | A47D 9/005 5/98.3 |
| 5,113,537 | A | 5/1992 | Turk | |
| 6,386,986 | B1 | 5/2002 | Sonner | |
| 8,844,072 | B2 | 9/2014 | Bellows | |
| 2009/0113625 | A1 | 5/2009 | Hutchinson | |
| 2012/0046117 | A1 | 2/2012 | Zhang | |
| 2015/0342367 | A1* | 12/2015 | Corso | A47D 9/005 5/102 |
| 2016/0106200 | A1* | 4/2016 | Brinkley | A45F 3/24 5/129 |
| 2016/0227939 | A1* | 8/2016 | Tadipatri | A47D 9/005 |

* cited by examiner

*Primary Examiner* — Peter M. Cuomo
*Assistant Examiner* — Adam C Ortiz

(57) ABSTRACT

A swivel rocker having a swivel rocker frame that in turn includes a rocker frame portion and a swivel frame portion that can induce the three types of motion of swivel or roll, rock or pitch, and spin or yaw. The swivel frame portion can be quickly engaged to and disengaged from the rocker frame portion. Each of the swivel frame portion and rocker frame portion is foldable to a compact form. Each of the swivel frame portion and rocker frame portion includes a hub portion, which hub portions are rotatable relative to each other and lockable relative to each other.

9 Claims, 14 Drawing Sheets

SWIVEL ROCKER WITH ROLL AND PITCH MOTION

This application is a continuation of U.S. patent application Ser. No. 15/608,522 filed May 30, 2017 (U.S. Pat. No. 10,779,659 issued Sep. 22, 2020) and claims the benefit thereof under 35 U.S.C. § 120, which application claims the benefit under 35 U.S.C. 119(e) of U.S. Provisional Patent Application No. 62/343,838 filed May 31, 2016, all of which applications are hereby incorporated by reference in their entireties into this application.

FIELD OF THE INVENTION

The present invention relates generally to a baby seat, particularly to a baby seat that rocks, and specifically to a baby seat that rocks and swivels.

BACKGROUND OF THE INVENTION

A car seat for an infant, baby, or toddler may place a premium on safety. A high chair may be designed for easy clean up. A carry sling may have comfort features for both the caregiver and baby. A running stroller rolls effortlessly and shields the young from one or more of the sun, rain, wind, heat and cold. A crib includes sides sufficiently tall to keep the baby in. These apparatus have unique structures and unique functions but none mimic the motion that a baby experiences before the baby is born.

SUMMARY OF THE INVENTION

A feature of the present invention is a swivel rocker.

Another feature of the present invention is a swivel apparatus.

Another feature of the present invention is a rocker apparatus.

Another feature of the present invention is a frame for a swivel rocker.

Another feature of the present invention is a frame for a swivel rocker that provides for motion about one or more of a roll and pitch axis.

Another feature of the prevent invention is the provision in a swivel rocker frame, of a rocker frame portion and a swivel frame portion.

Another feature of the prevent invention is the provision in a swivel rocker frame, of the rocker frame portion having first and second ends, where each of the first and second ends of the rocker frame portion includes an inside face, and where the first and second ends of the rocker frame define a swivel axis.

Another feature of the prevent invention is the provision in a swivel rocker frame, of the swivel frame portion having first and second ends, where each of the first and second ends of the swivel frame portion includes an outside face, and where the first and second ends of the swivel frame portion are on the swivel axis.

Another feature of the prevent invention is the provision in a swivel rocker frame, of the swivel frame portion being pivotally engagable to the rocker frame portion on the swivel axis in an open and operating position such that the inside face of the first end of the rocker frame portion confronts the outside face of the first end of the swivel frame portion and such that the inside face of the second end of the rocker frame portion confronts the outside face of the second end of the swivel frame portion.

Another feature of the prevent invention is the provision in a swivel rocker frame, of the swivel frame portion being engagable to and disengagable from the rocker frame portion.

Another feature of the prevent invention is the provision in a swivel rocker frame, where, after being disengaged from the rocker frame portion, the swivel frame portion is foldable such that the first and second ends of the swivel frame portion confront each other.

Another feature of the prevent invention is the provision in a swivel rocker frame, where, after being disengaged from the swivel frame portion, the rocker frame portion is foldable such that the first and second ends of the rocker frame portion confront each other.

Another feature of the prevent invention is the provision in a swivel rocker frame, where, when pivotally engaged to the rocker frame portion, the swivel frame portion is endless and defines a plane.

Another feature of the prevent invention is the provision in a swivel rocker frame, where, when disengaged from the rocker frame portion, the swivel frame portion is endless and is foldable to a U-shape.

Another feature of the prevent invention is the provision in a swivel rocker frame, where, when in the open and operating position, the rocker frame portion includes a first rocker and a second rocker, where each of the rockers extends from the first end of the rocker frame portion to the second end of the rocker frame portion, where each of the rockers are U-shaped, and where the rocker frame portion is endless.

Another feature of the prevent invention is the provision in a swivel rocker frame, where, when in the open and operating position, the rocker frame portion includes a first rocker and a second rocker, where each of the rockers extends from the first end of the rocker frame portion to the second end of the rocker frame portion, where the first rocker defines a first plane, where the second rocker defines a second plane, and where the first and second planes intersect each other at an oblique angle.

Another feature of the prevent invention is the provision in a swivel rocker frame, where, when in the open and operating position, the rocker frame portion includes a first rocker and a second rocker, where each of the rockers extends from the first end of the rocker frame portion to the second end of the rocker frame portion, where the first and second ends of the rocker frame portion alternately increase and decrease in elevation or pitch up and down when the rocker frame portion is rocked, where each of the first and second rockers includes an extendable foot having a distal end such that the rocker frame portion includes four feet, where each of the four feet is extendable downwardly toward a surface on which the rocker frame portion rocks, where the distal ends of the four feet define a first plane, where the first plane is at or below a lowest elevation of the first and second rockers such that the legs take at least a portion of a weight of the rocker frame portion such that the rocker frame portion is prevented from being rocked.

Another feature of the prevent invention is the provision in a swivel rocker frame, where, when disengaged from the swivel frame portion, the rocker frame portion includes a first rocker and a second rocker, and where the first and second rockers are pivotable to a position where the first and second rockers extend parallel to each other and are adjacent to each other.

Another feature of the prevent invention is the provision in a swivel rocker frame, where, when disengaged from the swivel frame portion, the rocker frame portion includes a first rocker and a second rocker, and where the first and second rockers are foldable to a position where the first end of the rocker frame portion confronts the second end of the rocker frame portion.

Another feature of the prevent invention is the provision in a swivel rocker frame, of at least a first connection hub, where the connection hub connects the first end of the rocker frame portion to the first end of the swivel frame portion, where the connection hub includes a swivel hub portion and a rocker hub portion that are pivotally engaged to each other such that the swivel frame portion swivels relative to the rocker frame portion, where the swivel hub portion is engaged to the swivel frame portion, where the rocker hub portion is engaged to the rocker frame portion, where the swivel hub portion and rocker hub portion are engagable and disengagable from each other to engage and disengage the swivel frame portion from the rocker frame portion.

Another feature of the prevent invention is the provision in a swivel rocker frame, of the swivel frame portion including an tubular elongate member, and of the swivel hub portion engaging the tubular elongate member such that when the tubular elongate member swivels about the first axis the swivel hub portion swivels too about the first axis, the swivel hub portion and the tubular elongate member swiveling relative to the rocker hub portion.

Another feature of the prevent invention is the provision in a swivel rocker frame, of the swivel hub portion being slidingly engagable to and slidingly disengagable from the rocker hub portion to engage and disengage the swivel frame portion from the rocker frame portion.

Another feature of the prevent invention is the provision in a swivel rocker frame, of the rocker frame portion including a first rocker and a second rocker, where the first and second rockers extend from the rocker hub portion and are swingable to and away from each other about the swivel axis such that the first and second rockers are swingable to a first position where the first and second rockers are adjacent to each other and to a second position where the first and second rockers are spaced apart and in an open and operating position.

Another feature of the present invention is the provision in a swivel rocker frame, of a baby receptacle engaged to and depending from the swivel frame portion, where the baby receptacle includes flexible material, and where the baby receptacle is spaced from the rocker frame portion.

An advantage of the present invention is motion that can mimic the motion of a baby before the baby was born, where the baby was swimming in a body of amniotic fluid.

Another advantage of the present invention is that a baby may be rocked so as to gently pitch up and down. One feature contributing to this advantage is the pair of rockers extending from the first end to the second end of the rocker frame portion.

Another advantage of the present invention is that a baby may be rolled gently about a spin axis. One feature contributing to this advantage is the swivel portion of the rocker that permits roll about the spin axis.

Another advantage of the present invention is that a baby may be moved gently about a yaw axis. One feature contributing to this advantage is the U-shape of each of the rockers that permits the swivel rocker frame as a whole to be gently spun about a vertical or yaw axis.

Another advantage of the present invention is that a baby may be moved about any of one of a pitch, spin and yaw axis.

Another advantage of the present invention is that a baby may be moved about any two of a pitch, spin and yaw axis at the same time.

Another advantage of the present invention is that a baby may be moved about all three of a pitch, spin and yaw axis at the same time.

Another advantage of the present invention is that a baby may be kept motionless. The rocker frame portion includes legs to prevent rocking and the hub connection may be locked to prevent swiveling.

Another advantage of the present invention is compact storage. The swivel frame portion can be disengaged from the rocker frame portion and then each of the swivel frame portion and rocker frame portion can be folded.

Another advantage is that the swivel rocker frame is inexpensive to manufacture.

Another advantage is that the swivel rocker frame is simple to assemble (engage the swivel frame portion and rocker frame portion to each other), simple to use, and simple to disassemble (disengage the swivel frame portion from the rocker frame portion).

Another advantage of the present invention is that the swivel frame portion cannot be placed upon the rocker frame portion until the rocker frame portion is locked.

Another advantage of the present invention is that rocker frame portion cannot be drawn into a compact position until the swivel frame portion is removed from the rocker frame portion.

DETAILED DESCRIPTION

Figure 1A:
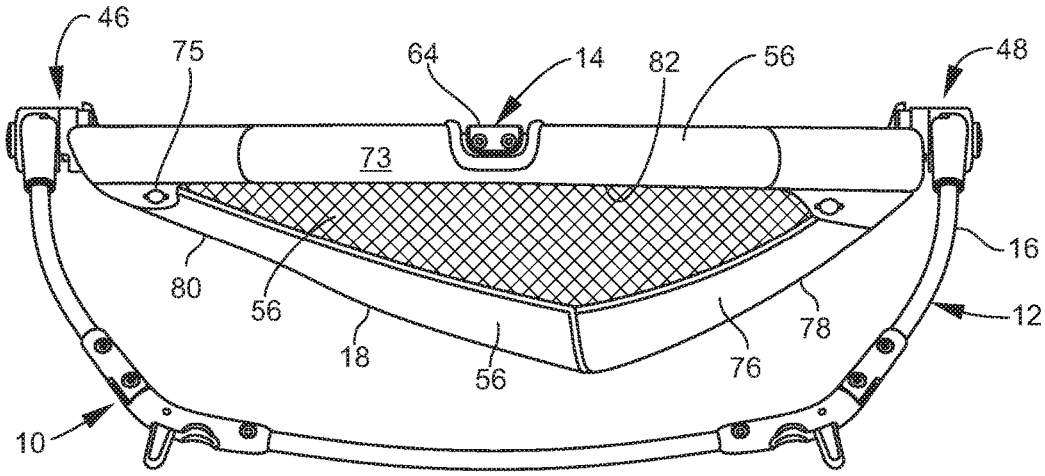
FIG. 1A is a side elevation view of the swivel rocker of the present invention showing a frame and soft components of the swivel rocker.
Figure 1B:
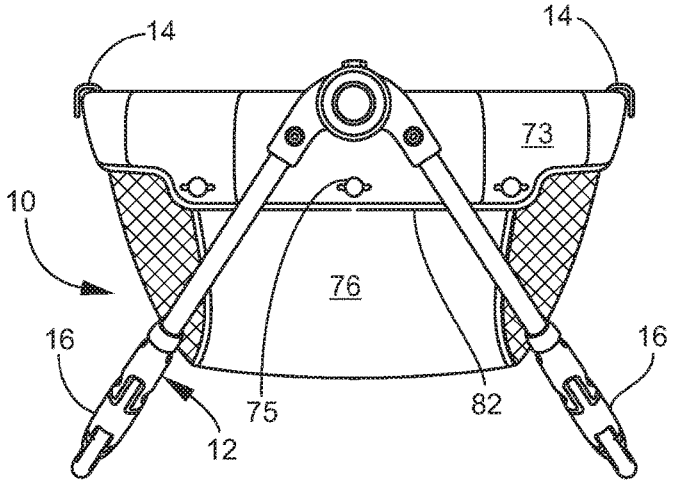
FIG. 1B is an end elevation view of the swivel rocker of FIG. 1A.
Figure 1C:
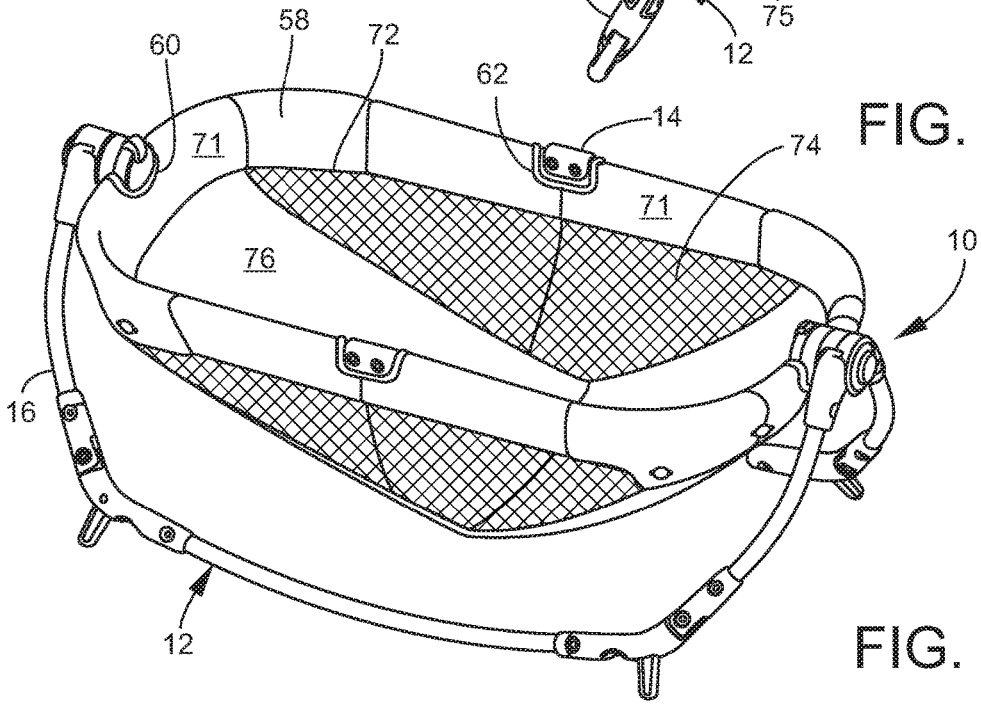
FIG. 1C is a perspective view of the swivel rocker of FIG. 1A.
Figure 2A:
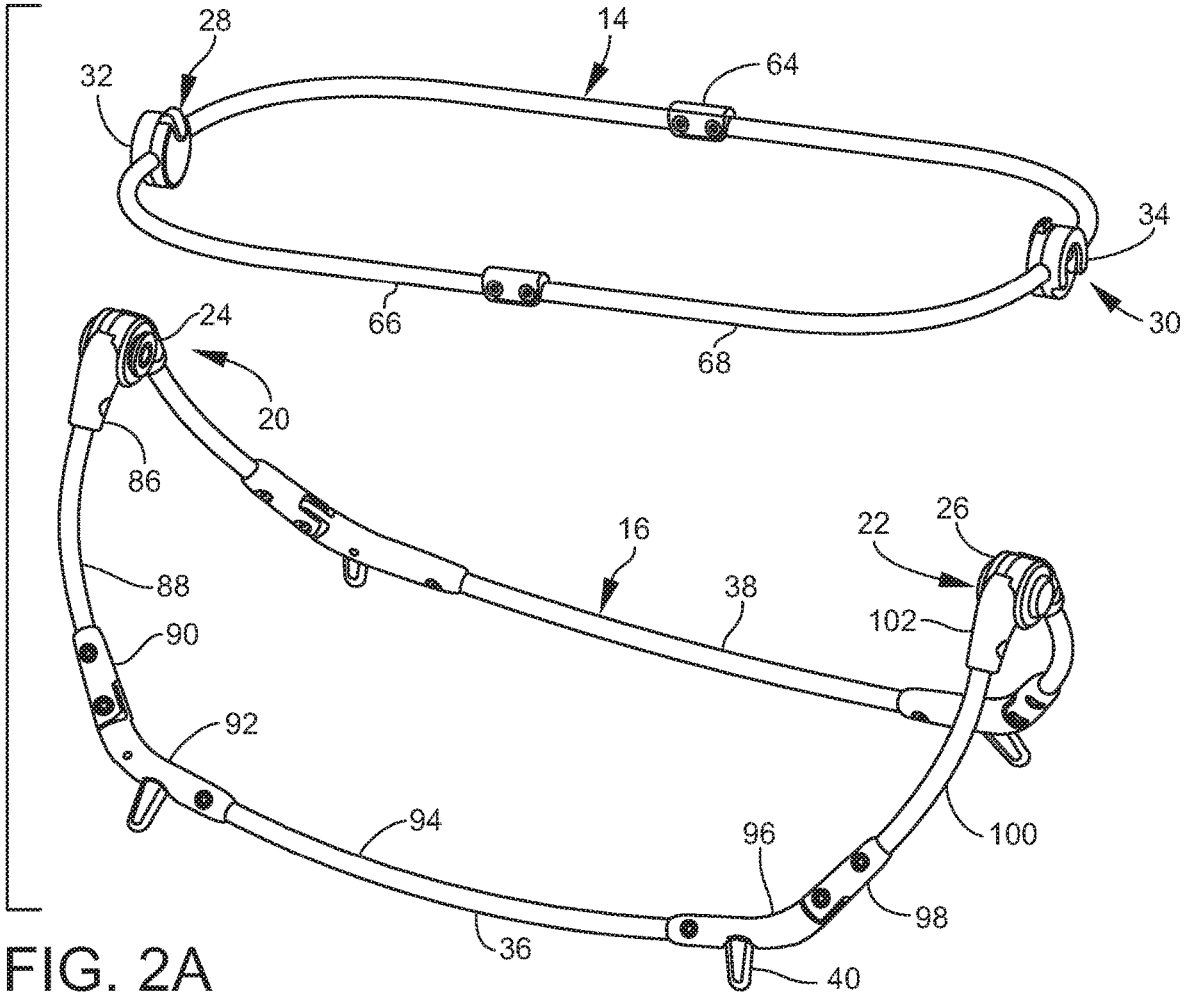
FIG. 2A is a broken apart perspective view of the frame of the swivel rocker of FIG. 1A.

As shown in FIGS. 1A, 1B and 1C, the present swivel rocker is indicated in general by reference number 10. As shown in FIG. 2A, swivel rocker 10 includes a frame 12 having a swivel frame portion 14 and a rocker frame portion 16. As shown in FIGS. 1A, 1B, and 1C, swivel rocker 10 includes a baby receptacle or hammock 18 that includes flexible material such as fabric and sheeting. Baby receptacle 18 is engaged to and depends from the swivel frame portion 14.

The rocker frame portion 16 includes first and second ends 20, 22. First end 20 includes a first inside face 24. Second face 22 includes a second inside face 26. The first and second ends 20, 22 define a swivel axis.

The swivel frame portion 14 includes a first end 28 and a second end 30. First end 28 includes a first outside face 32. Second end 30 includes a second outside face 34. The first and second ends 28, 30 are on the swivel axis.

Figure 5A:
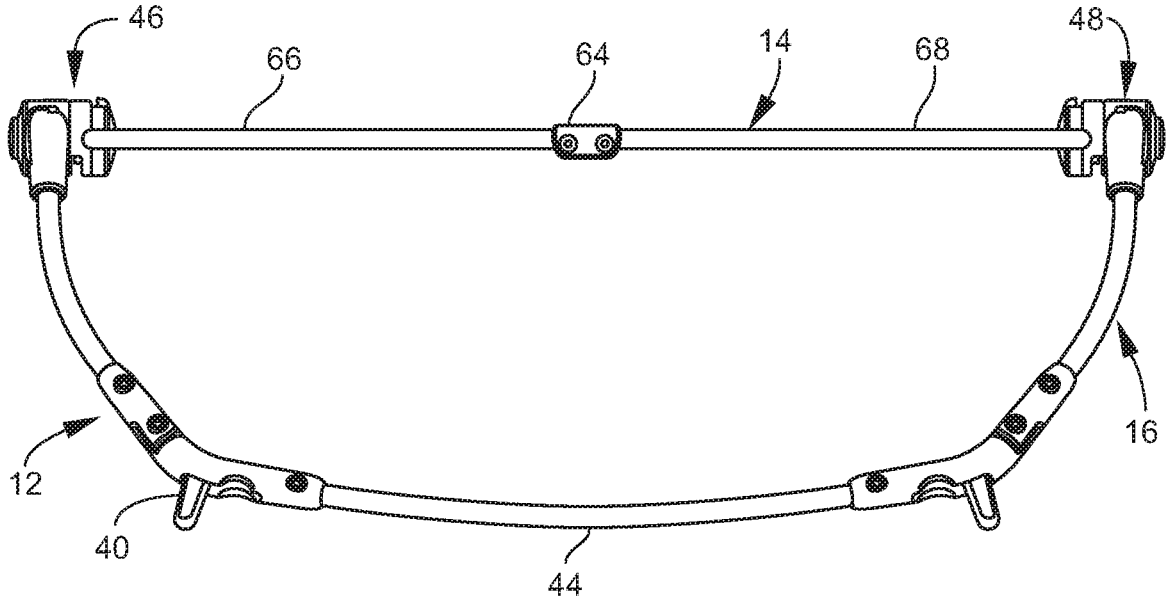
FIG. 5A is a side elevation view of the swivel rocker frame of FIG. 2A, where stops of the rockers of the swivel rocker frame have been extended to prevent the rockers from rocking.
Figure 5B:
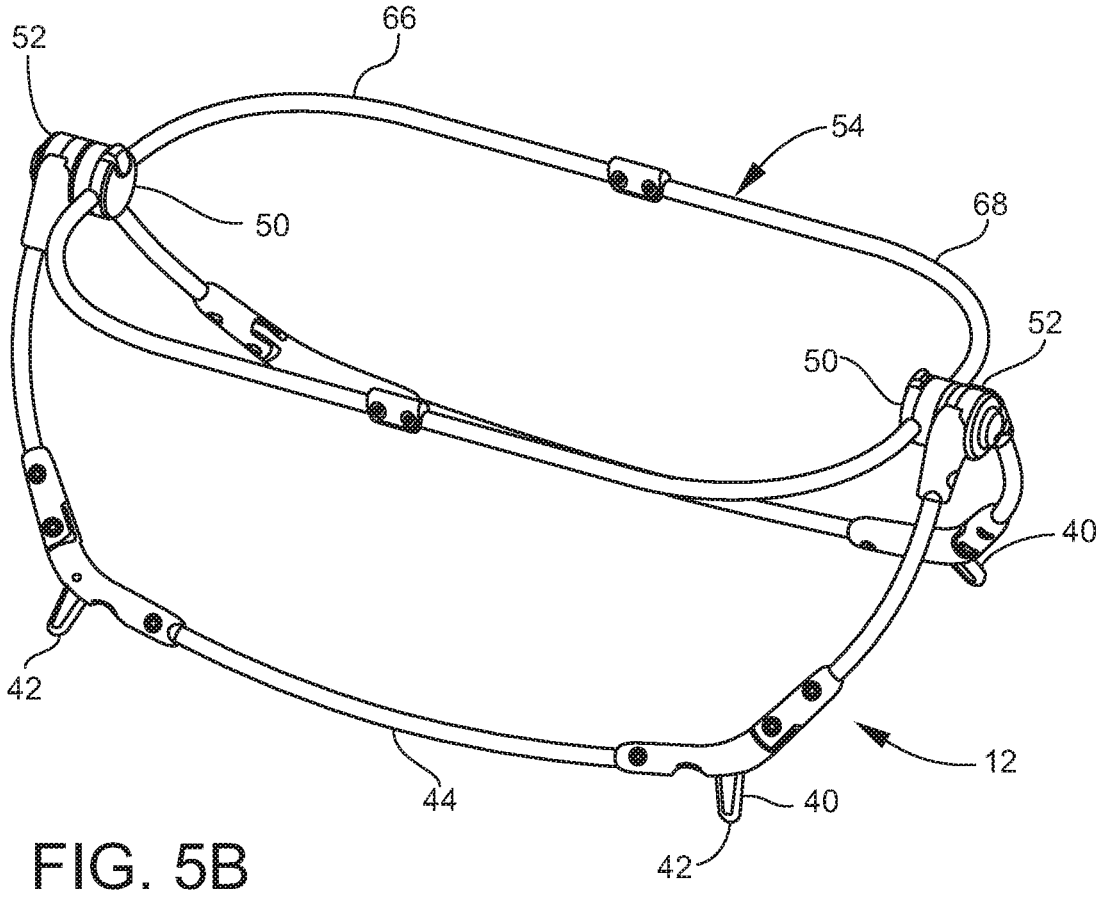
FIG. 5B is a perspective view of the swivel rocker frame of FIG. 5A.

As shown in FIGS. 5A and 5B, the swivel frame portion 14 is pivotally engaged to the rocker frame portion 16 on the swivel axis in an open and operating position such that the first inside face 24 of the first end 20 of the rocker frame portion 16 confronts the first outside face 32 of the first end 28 of the swivel frame portion 14 and such that the second inside face 26 of the second end 22 of the rocker frame portion 16 confronts the second outside face 34 of the second end 30 of the swivel frame portion.

Figure 10A:
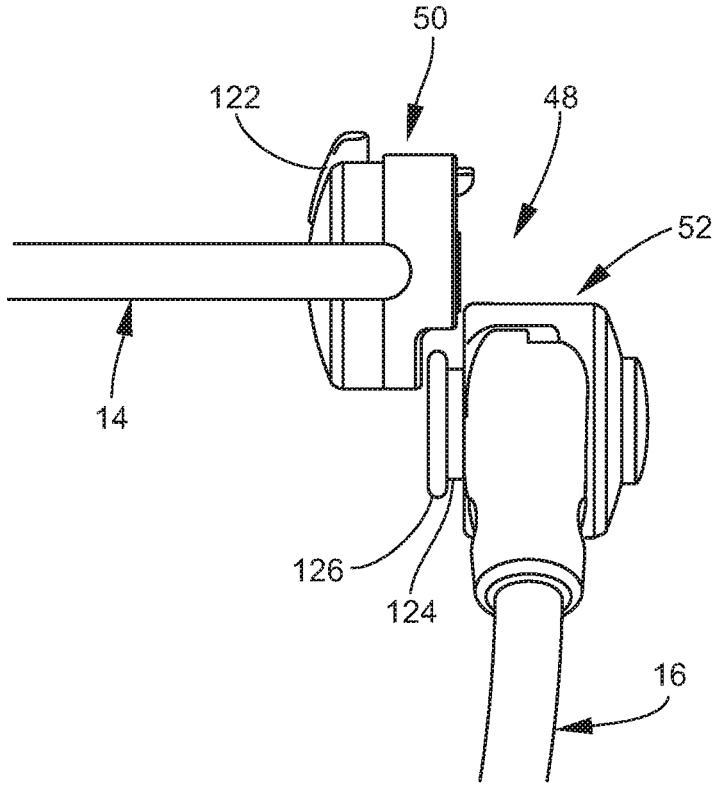
FIG. 10A is a side elevation view of the connection between the swivel portion and rocker portion of FIG. 9A, showing the swivel portion and rocker portion about to be engaged to each other by being slideably engaged.
Figure 10B:
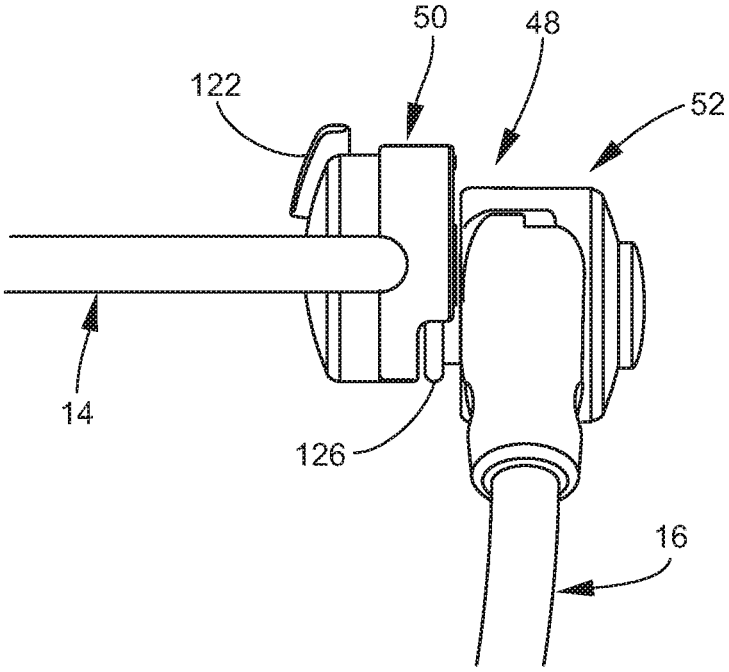
FIG. 10B is a side elevation view of the connection between the swivel portion and rocker portion of FIG. 10A, showing the swivel portion having been just disengaged from the rocker portion.

As shown in FIGS. 10A and 10B, the swivel frame portion 14 is engagable to and disengagable from the rocker frame portion 16.

Figure 4A:
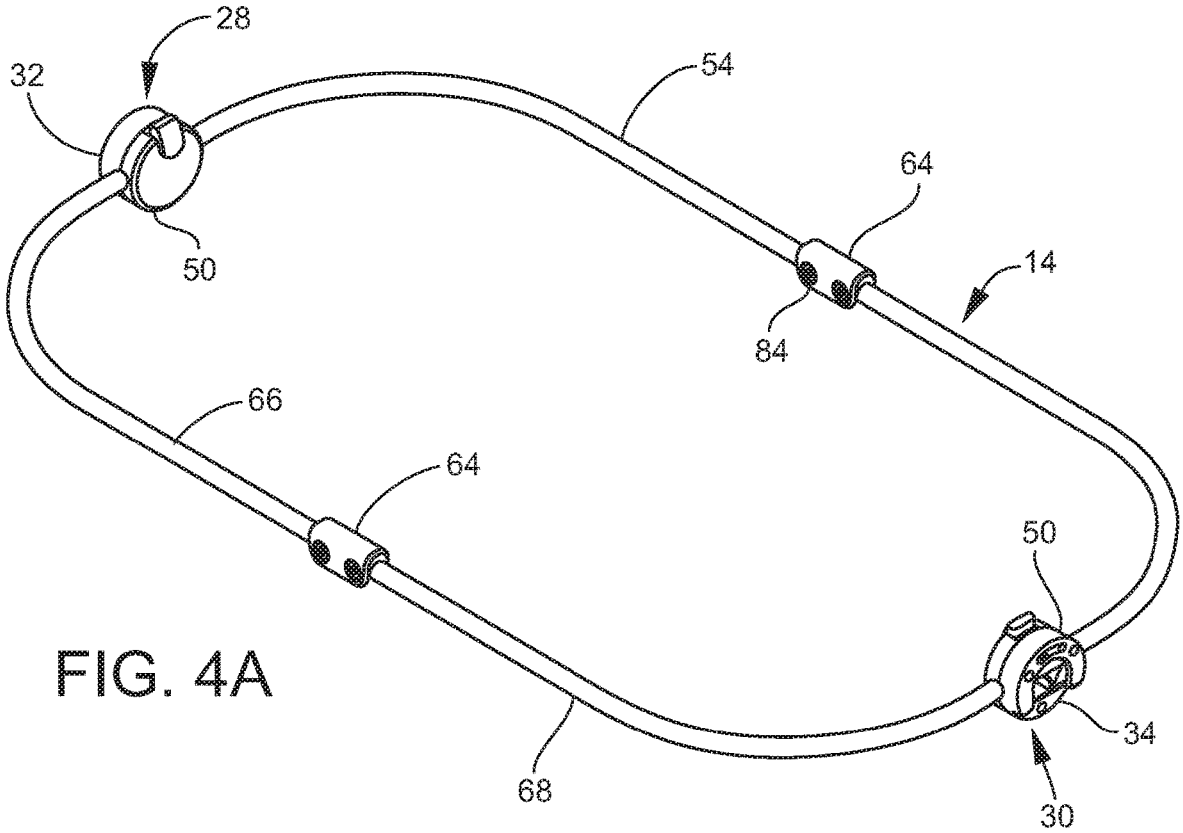
FIG. 4A is a perspective view of frame of the swivel portion of the swivel rocker frame of FIG. 2A, where the swivel portion frame is in a folded out and operating position.
Figure 4B:
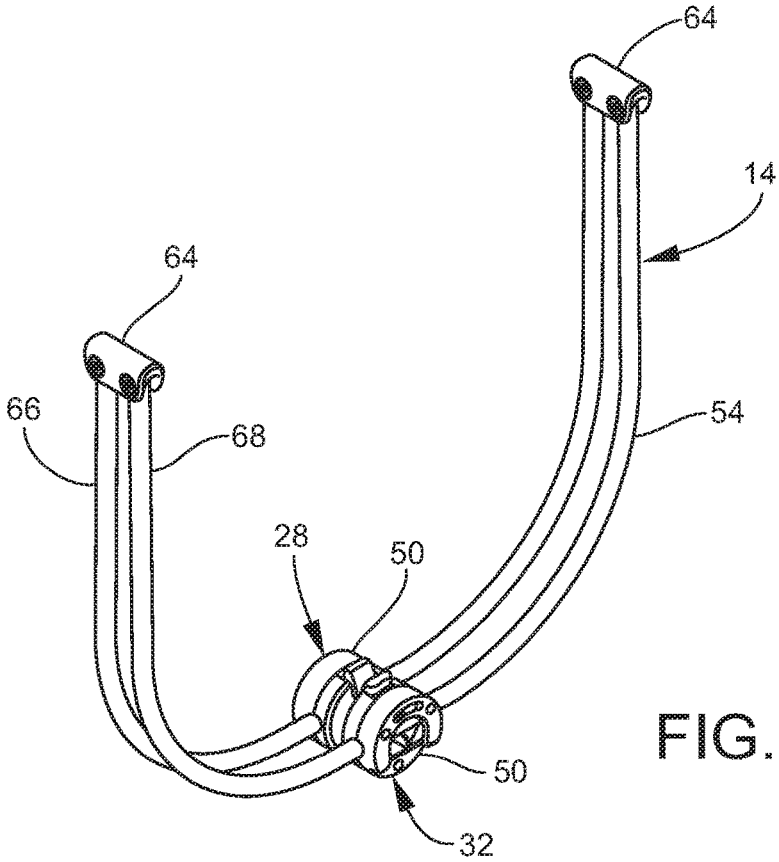
FIG. 4B is a perspective view of the swivel portion frame of FIG. 4A, where the swivel portion frame is in a folded and compact position.

As shown in FIGS. 4A and 4B, after being disengaged from the rocker frame portion 16, the swivel frame portion 14 is foldable such that the first and second ends 28, 30 of the swivel frame portion 14 confront each other.

Figure 3A:
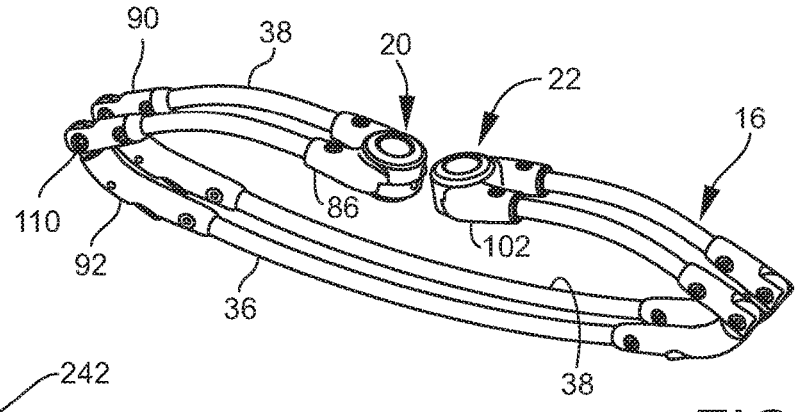
FIG. 3A is a perspective view of the frame of the rocker portion of the swivel rocker frame of FIG. 2A, where the rocker portion frame is in a folded and compact position.
Figure 3B:
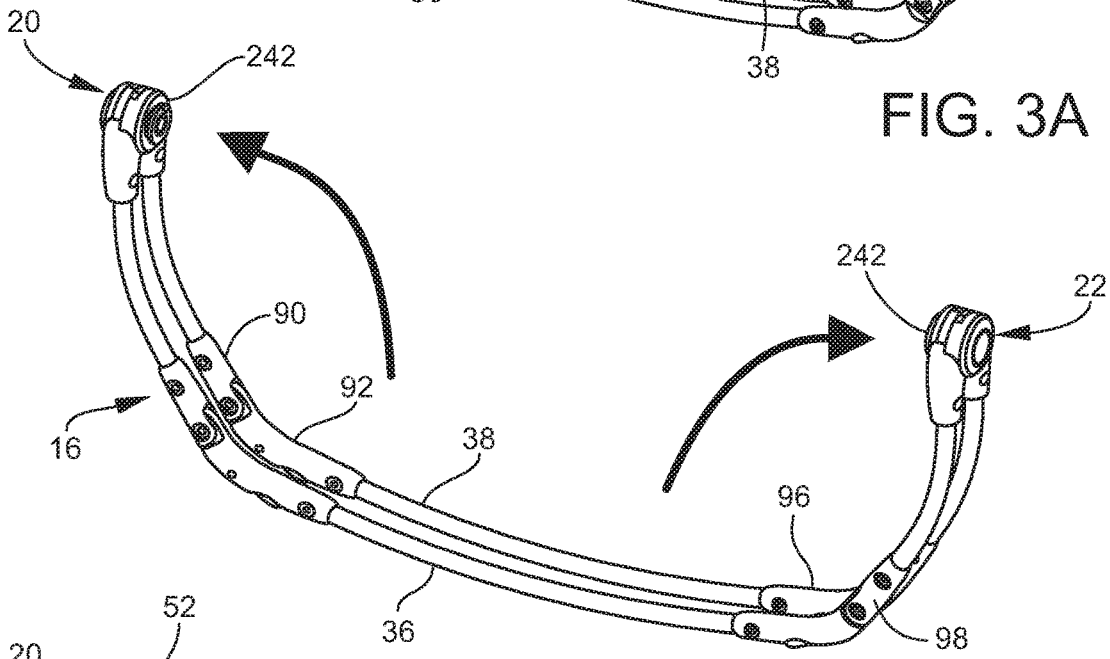
FIG. 3B is a perspective view of the rocker portion frame of FIG. 3A, where the rocker portion frame is in an intermediate state where ends of the rocker portion frame are folded out and rockers are adjacent to each other.
Figure 3C:
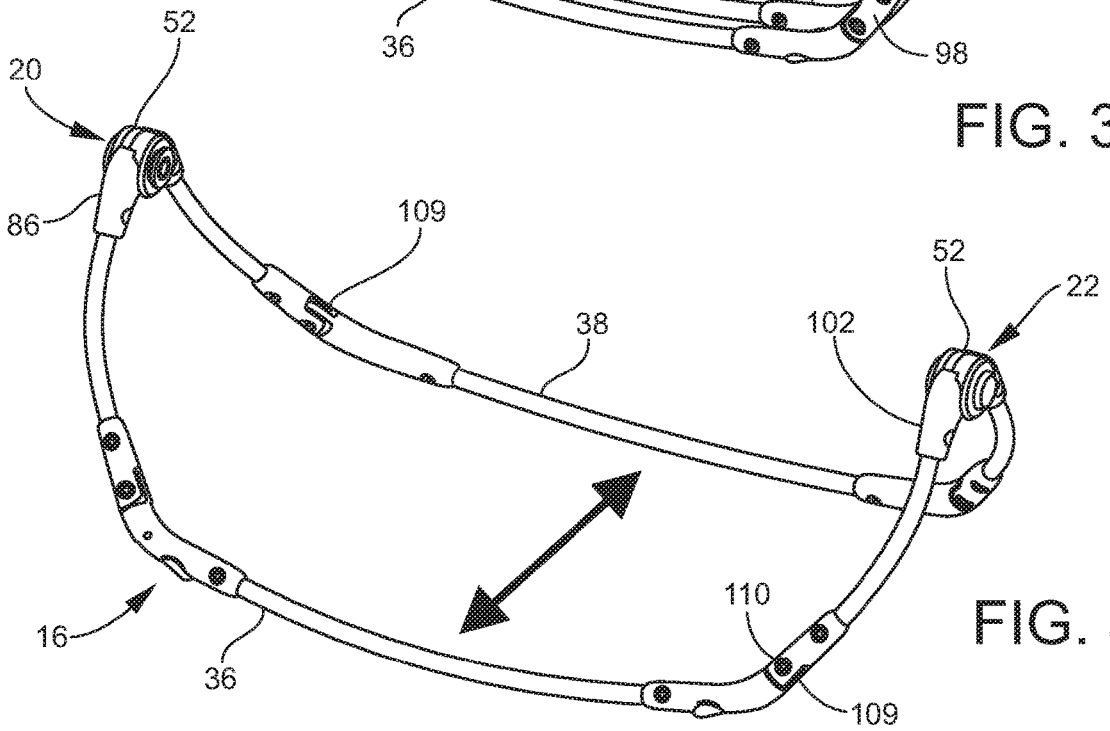
FIG. 3C is a perspective view of the rocker portion frame of FIG. 3A, where the rockers of the rocker portion frame have been drawn apart to an operating position.

As shown in FIGS. 3A, 3B, and 3C, after being disengaged from the swivel frame portion 14, the rocker frame portion 16 is foldable such that the first and second ends 20, 22 of the rocker frame portion 16 confront each other.

As shown in FIG. 5B, when pivotally engaged to the rocker frame portion 16, the swivel frame portion 14 is endless and defines a plane.

As shown in FIG. 4B, when disengaged from the rocker frame portion 16, the swivel frame portion 14 is endless and is foldable to a U-shape.

As shown in FIGS. 5A and 5B, when in the open and operating position, the rocker frame portion 16 includes a first rocker 36 and a second rocker 38. Each of the rockers 36, 38 extend from the first end 20 of the rocker frame portion 16 to the second end 22 of the rocker frame portion 16. Each of the rockers 36, 38 is U-shaped. The rocker frame portion 16 is endless.

As shown in FIGS. 5A and 5B, when in the open and operating position, the first rocker 36 defines a first plane, the second rocker 38 defines a second plane, and such first and second planes intersect each other at an oblique angle.

When in the open and operating position, the first and second ends 20, 22 of the rocker frame portion 16 alternately increase and decrease in elevation when the rocker frame portion 16 is rocked. Each of the first and second rockers 36, 38 include an extendable foot 40 having a distal end 42 such that the rocker frame portion 16 includes four feet. Each of the four feet 40 extend downwardly and obliquely toward a surface on which the rocker frame portion 16 rocks. The distal ends 42 of the four feet 40 define a first plane. The first plane is at or below a lowest elevation, designated by reference number 44, of the first and second rockers 36, 38, such that the legs 40 take at least a portion of a weight of the rocker frame portion 16 such that the rocker frame portion 16 is prevented from being rocked.

As shown in FIG. 3B, the first and second rockers 36, 38 are pivotable, when the rocker frame portion 16 is disengaged from the swivel frame portion 14, from the open and operating position where the first and second rockers 36, 38 are spaced apart to a position where the first and second rockers 36, 38 extend parallel to each other and are adjacent to each other.

As shown in FIG. 3A, the first and second rockers 36, 38 are foldable, when the rocker frame portion 16 is disengaged from the swivel frame portion 14, from a position where the first and second rockers 36, 38 extend parallel to each other and are adjacent to each other to a position where the first end 20 of the rocker frame portion 16 confronts the second end 22 of the rocker frame portion 16.

As shown in FIG. 1A, the swivel rocker frame 12 includes at least a first connection hub 46. Preferably, swivel rocker frame 12 includes first and second connection hubs 46, 48. The first connection hub 46 connects the first end 20 of the rocker frame portion 16 to the first end 28 of the swivel frame portion 14. The second connection hub 48 connects the second end 22 of the rocker frame portion 16 to the second end 30 of the swivel frame portion 14. Each of the first and second connection hubs 46, 48 includes a swivel hub portion 50 and a rocker hub portion 52 that are pivotally engaged to each other such that the swivel frame portion 14 swivels relative to the rocker frame portion 16. The swivel hub portion 50 is engaged to the swivel frame portion 14. The rocker hub portion 52 is engaged to the rocker frame portion 16. The swivel hub portion 50 and rocker hub portion 52 are engagable and disengagable from each other to engage and disengage the swivel frame portion 14 from the rocker frame portion 16.

As shown in FIG. 5B, the swivel frame portion 14 includes a tubular elongate member 54. The swivel hub portion 50 engages the tubular elongate member 54 such that when the tubular elongate member 54 swivels about the first axis the swivel hub portion 50 swivels too about the first axis. The swivel hub portion 50 and the tubular elongate member 54 swivel relative to the rocker hub portion 52. As shown in FIGS. 10A and 10B, the swivel hub portion 50 is slidingly engagable to and slidingly disengagable from the rocker hub portion 52 to engage and disengage the swivel frame portion 50 from the rocker frame portion 52.

As shown in FIG. 3C, the rocker frame portion 16 includes the first rocker 36 and the second rocker 38. The first and second rockers 36, 38 extend from the rocker hub portion 52 and are swingable to and away from each other about the swivel axis such that the first and second rockers 36, 38 are swingable to a first position, shown in FIG. 3B, where the first and second rockers 36, 38 are adjacent to each other and to a second position, shown in FIG. 3C, where the first and second rockers 36, 38 are spaced apart and in an open and operating position.

As shown in FIGS. 1A, 1B and 1C, the baby receptacle 18 of the swivel rocker 10 is engaged to and depends from the swivel frame portion 14. The baby receptacle 18 includes flexible material 56. The baby receptacle 18 is spaced from the rocker frame portion 16.

As shown in FIGS. 1A, 1B and 1C, the baby receptacle 18 includes the flexible material 56 which includes generally three sections. A U-shaped first section 58 depends from and is engaged to the tubular elongate member 54 and includes end cutouts 60 and side cutouts 62. End cutouts 60 run adjacent to the perimeter of the swivel hub portions 50 so as to permit the swivel hub portions 50 to be exposed and accessible to a caregiver such that the swivel hub portions 50 can be locked and unlocked and such that the swivel hub portions 50 can be slidingly engaged to and slidingly unengaged from the rocker hub portion 52. Side cutouts 62 permit exposure to hinge bodies 64 that engage a first portion 66 of the tubular elongate member 54 to a second portion 68 of the tubular elongate member 54. Each of the cutouts 60, 62 includes a flexible reinforcement strip 70 stitched about the periphery of the cutout 60, 62 such that each flexible reinforcement strip includes an inside U-shaped portion and an outside U-shaped portion.

The first section 58 includes an inner side 71 having an inside lower edge 72 and an outer side or flap 73 such that the inner side 71 and outer side 73 form an inverted U-shape. The inside lower edge 72 of the inner side 71 is engaged to a second section 74 formed of a flexible mesh and is further engaged to a third section 76 upon which the infant or baby directly rests. The outside flap 73 is buttoned with buttons 75 back to one or more of the inner side 71, second section 74, and third section 76.

The second section 74 is a flexible mesh engaged between the inner side 71 of the first section 58 and the third section 76. Mesh second section 74 is located on both sides of the baby receptacle 18. Mesh permits better air circulation in the baby receptacle 18.

The third section 76 is a relatively wide piece or spread of flexible material or fabric that runs essentially from one end of the baby receptacle 18 to the other end of the baby receptacle 18 and cradles the head, back, rear end, and legs of a baby or infant. Portion 78 of third section 76 having a relatively great incline cradles the head and back. Portion 80 of the third section 76 having a relatively small incline cradles the rear end and legs. The upper ends of portions 78, 80 are engaged, such as by stitching, to the lower edge 72 of the inner side 71 of the first section 58 at locations adjacent to swivel hub portions 50.

The outer side or flap 73 of the first section 58 includes a lower edge 82. The lower edge 82 runs about the entire baby receptacle 18 and is adjacent to the tubular elongate member 54. Buttons 75 are stitched to one or more of the inner side 71, mesh second section 74, or body support third section 76. Buttons 75 pass through respective button slits formed in flap 73. A button is a quick connect mechanism. Buttons 75 may be replaced by another quick connect mechanism such as a hook and loop quick connect mechanism such as Velcro®, where one of the hook material and loop material may be on the outer face of the inner side 71 of the first section 58 and where the other of the hook material and loop material may be on the inner face of the flap 73. A quick connect mechanism is engaged to the flap 73 such that the flap 73 can be disengaged from the tubular elongate member 54 such that that baby receptacle 18 can be removed from the swivel frame portion 14 and washed. Baby receptacle 18, including U-shaped first section 58, mesh second section 74, and body supporting third section 76, are formed of a flexible material such as a flexible fabric, flexible textile, flexible mesh, flexible sheeting, flexible plastic or flexible polymer.

Figure 2B:
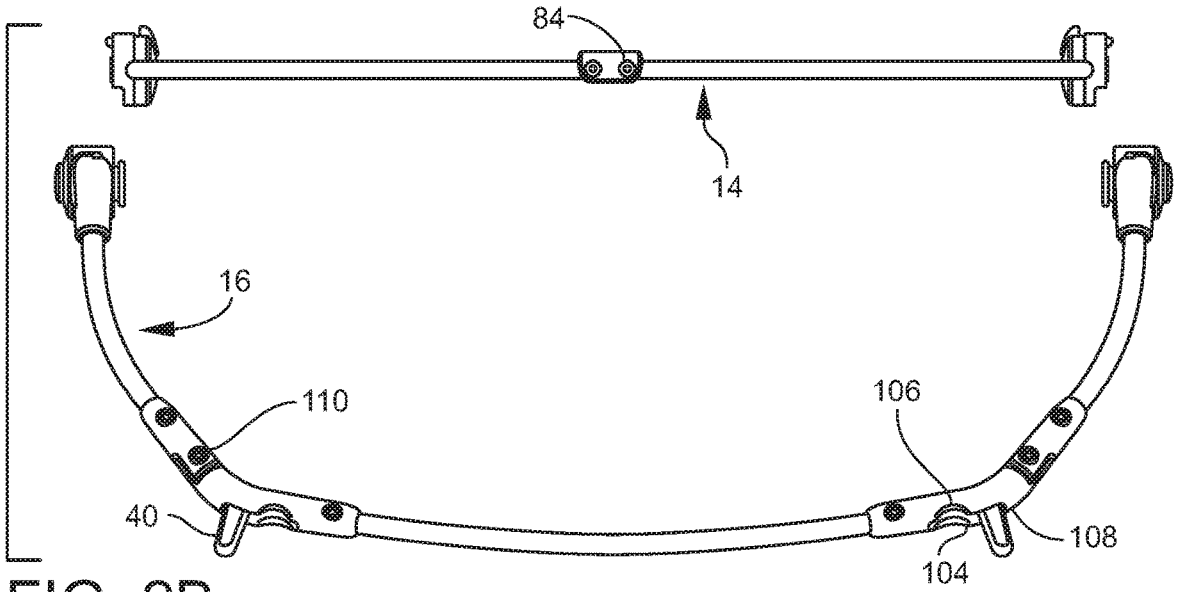
FIG. 2B is a broken apart side elevation view of the swivel rocker frame of FIG. 2A.

FIGS. 2A and 2B show the swivel frame portion 14 and rocker frame portion 16. Swivel frame portion 14 is endless and includes the tubular frame member 54 and the swivel hub portion 50. Tubular frame member 54 passes through and is frictionally engaged to swivel hub portion 50. Tubular frame member 54 includes a first U-shaped portion 66 and a second U-shaped portion 68. The U-shaped portions 66, 68 are pivotally engaged at their ends by pivot pins 84 to hinge bodies 64. Each of the hinge bodies 64 is U-shaped in section. Hinge body 64 acts as a stop to minimize pivoting in one direction and includes a downward opening to permit pivoting in the other direction, as shown in FIG. 4B. Elongate tubular members 54 define a horizontal plane, as shown in FIG. 2B.

FIGS. 2A and 2B also show the rocker frame portion 16. Rocker frame portion 16 is endless and includes the rocker hub portion 52 and the rockers 36, 38. Starting from first end 20 of the rocker frame portion 16, each of the rockers 36, 38 includes a receiver 86 for an elongate tubular member 88. The proximal end of the receiver 86 is pivotally connected to rocker hub portion 52. The distal end of the receiver 86 is fixed to the proximal end of the elongate tubular member 88. Elongate tubular member 88 is curved from end to end.

The distal end of the elongate tubular member 88 is engaged in a receiver 90. The distal end of receiver 90 is pivotally engaged to a receiver 92. Receiver 92 receives and engages an elongate tubular member 94 at one end of the elongate tubular member 94. At the other end of the elongate tubular member 94, the elongate tubular member 94 is received and engaged by a receiver 96. Receiver 96 is pivotally engaged to a receiver 98. In turn, receiver 98 is fixedly engaged to one end of an elongate tubular member 100. The other end of the elongate tubular member 100 is received and engaged in receiver 102, which is pivotally affixed to the rocker hub portion 52.

Receivers 86 and 102 are identical to each other, and four of these receivers 86, 102 are found on the rocker frame portion 16. Receivers 86, 102 are female members. Their respective elongate tubular members 88 and 100 are male members.

Receivers 90 and 98 are identical to each other, and four of these receivers 90, 98 are found on the rocker frame portion 16. Receivers 90 and 98 are female members respective to their elongate tubular members 88 and 100. Receivers 92 and 96 are identical to each other, and four of these receivers 92, 96 are found on the rocker frame portion 16. Receivers 92 and 96 are female members respective to elongate tubular member 94.

Each of the receivers 92, 96 includes the foot 40. Foot 40 is pivotable into and out of its respective receiver 92, 96 so as to extend transversely relative to its respective receiver 92, 96. Each of the receivers 92, 96 includes a slot 104 into and out of which foot 40 retracts and extends. Slot 104 includes a curved recess 106 on each of the sides of the slot 104 to permit access by the thumb and forefinger to pinch the foot 40. Slot 104 includes a slot end 108 that works as a stop against the foot 40 such that the pivoting of the foot 40 stops as the foot 40 hits the slot end 108. Slot 104 and slot end 108 may be configured to work as a snap such that foot 40 remains extended and in an operating position regardless of whether a given amount of pivoting pressure is placed on the foot 40 in either of the pivoting directions. At a pressure less than the given amount of pivoting pressure, foot 40 remains extended. At a pressure greater than the given amount of pivoting pressure, such as by a finger or hand applying such an amount of pressure, foot 40 is retracted into its respective receiver 92, 96.

When all four feet 40 are extended, all or any of the respective four distal ends 42 may bear upon a surface upon which the swivel rocker 10 rests, or may confront such a surface, or may be adjacent to and spaced from such a surface, such that a rocking of swivel frame 10 is minimized. The lowest elevation point on rockers 36, 38, i.e., rocker location 44 that is found on each of the rockers 36, 38, may also bear upon such a surface upon which the swivel rocker 10 rests, or may confront such a surface, or may be adjacent to and spaced from such a surface. When all four feet 40 are extended, swivel rocker 10 does not rock.

The connection between receiver 92 and 90 may be a tongue connection. In other words, receiver 92 includes an end tongue 109 that extends into an end tongue receiving slot of receiver 90. A pivot pin 110 pivotally engages the tongue 109 in the end tongue receiving slot.

FIGS. 3A, 3B and 3C show the folding out of the rocker frame portion 16. In FIG. 3A, in a stored and compact position, receivers 86 and 102 have been pivoted relative to their respective rocker hub portions 52, thereby drawing together rockers 36 and 38. Further in FIG. 3A, receivers 90 and 92 have been pivoted relative to each other about pin 110 and receivers 96 and 98 have been pivoted relative to each other about pin 110 to as to draw ends 20 and 22 adjacent to each other. The step of drawing ends 20 and 22 inwardly is terminated by upper edges of receivers 90 and 98 hitting respective ends of receivers 92 and 96.

In FIG. 3B, ends 20 and 22 have been pivoted about pins 110 so as to draw ends 20 and 22 outwardly from the draw in position shown in FIG. 3A. The step of drawing ends 20 and 22 outwardly is terminated by ends of receivers 90 and 98 hitting respective ends of receivers 92 and 96.

In FIG. 3C, rockers 36 and 38 are drawn outwardly to an open and operating position from a position shown in FIG. 3B where the rockers 36 and 38 are adjacent to each other. In FIG. 3C, each of the rockers 36 and 38 define first and second planes, respectively, and such first and second planes obliquely intersect each other. The step of drawing rockers 36 and 38 apart is terminated by stops interacting between receivers 86 and 102 and their respective rocker hub portions 52. The rockers 36 and 38 can be snapped into the open and operating position shown in FIG. 3C and can be snapped out of such open and operating position.

To fold the swivel rocker 10 from the open and operating position shown in FIG. 3C to the intermediate position shown in FIG. 3B, button 224 is pressed and inward pressure is brought to bear upon the rockers 36 and 38, such that the rockers 36 and 38 are snapped out of drawn apart, open and operating position and pushed into the intermediate position. From the intermediate position of FIG. 3B where the rockers 36, 38 are adjacent to each other and where the ends 20, 22 are still at an upright position, inward pressure is brought to bear on the outer faces of the rocker hub portions 52 so as to pivot the receivers 90 and 92 relative to each other and so as to pivot the receivers 96 and 98 relative to each other so as to draw the ends 20, 22 to an adjacent or confronting position relative to each other, where upper edges or receivers 90 and 98 may abut end edges of receivers 92 and 96.

FIGS. 4A and 4B show, respectively, the open and operating position of the swivel frame portion 14 and the closed and compact position of the swivel frame portion 14. The elongate tubular members 54 define a plane in FIG. 4A.

In FIG. 4B, the elongate tubular member of the first portion 66 defines a first plane and the elongate tubular member of the second portion 68 defines a second plane, and such first and second planes are adjacent to each other and are face to face with each other. Each of the swivel hub portions 50 may spin on its respective tubular member 54 such that the inside faces of the swivel hub portions 50 may oppose each other in each of the open position of FIG. 4A and the closed position of FIG. 4B. When the baby receptacle 18 is on the swivel frame portion 14, the weight of the baby receptacle 18 draws the elongate tubular members 54 downwardly, which urges the inner ends of the U-shaped portions 66 and 68 downwardly and inwardly and against inner upper faces of the channel in hinge bodies 64, which prevents the U-shaped portions 66 and 68 from collapsing.

When rotated from the open position of FIG. 4A to the closed position of FIG. 4B, the outer ends of the U-shaped portions 66, 68 are drawn downwardly and inwardly and the inner ends of the U-shaped portions 66, 68 are free to pivot within hinge body 64.

FIGS. 5A and 5B show the swivel frame portion 14 engaged to the rocker frame portion 16. As shown in FIG. 5A, the overall length of the rocker frame portion 16 is greater than the overall length of the swivel frame portion 14. The swivel frame portion 14 is engaged inside of the rocker frame portion 16. As shown in FIGS. 1B and 8B, the overall width of rocker frame portion 16 is equal to or greater than the overall width of swivel frame portion 14 to maximize stability of the swivel rocker frame 12.

Figure 6A:
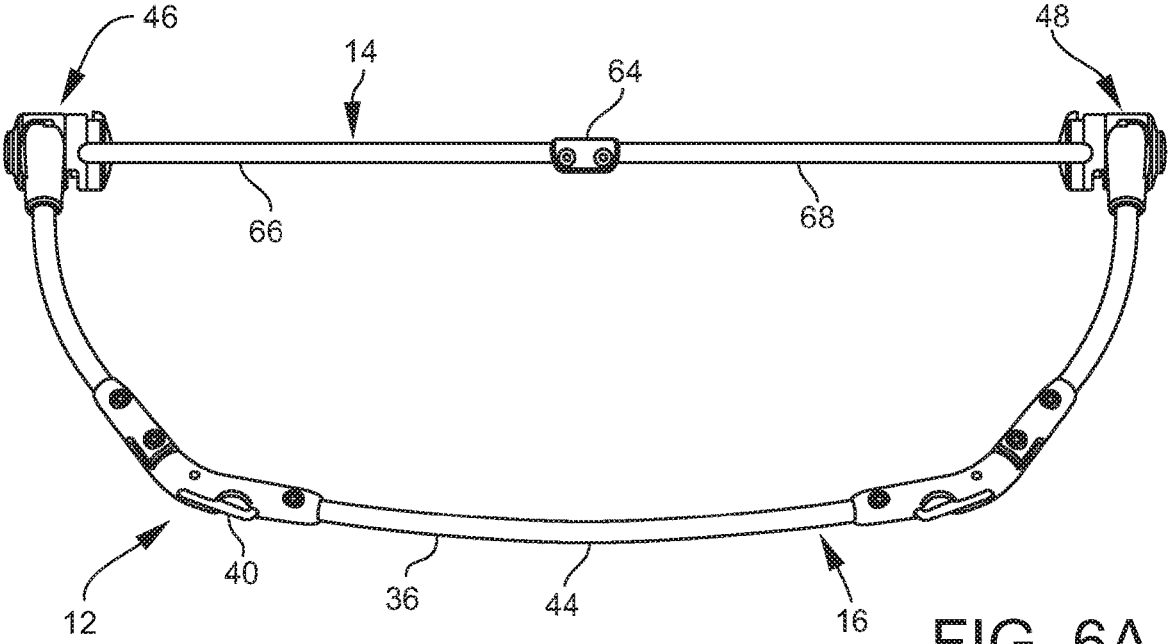
FIG. 6A is a side elevation view of the swivel rocker frame of FIG. 5A, where the stops of the rockers have been retracted to permit the rockers to rock.
Figure 6B:
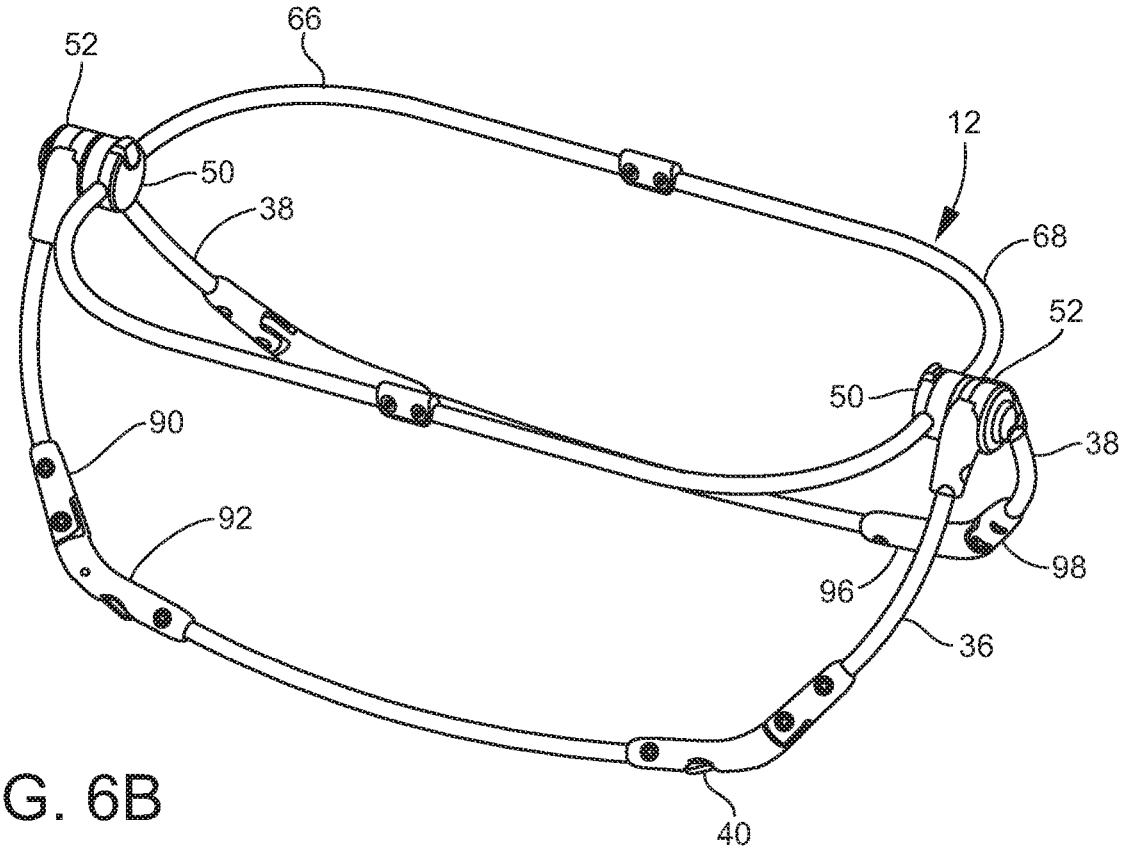
FIG. 6B is a perspective view of the swivel rocker frame of FIG. 6A.

FIGS. 5A and 5B show the feet 40 extended. FIGS. 6A and 6B show the feet 40 retracted. Swivel rocker 10 may be operated with or without feet 40 extended. In other words, when swivel frame portion 14 is engaged to rocker frame portion 16, swivel rocker 10 may be operated with or without feet 40 extended. That is, when feet 40 are extended, such as shown in FIGS. 5A and 5B, the swivel frame portion 14 may be swiveled to provide spin motion for the baby in the baby receptacle 18 and may be slid around a vertical axis to provide yaw motion for a baby in the baby receptacle 18. When the feet 40 are retracted, such as shown in FIGS. 6A and 6B, the swivel frame portion 14 may be swiveled to provide spin motion, slid around a vertical axis to provide yaw motion, and rocked in concert with the rocker frame portion 16 to provide pitch motion for a baby in the baby receptacle 18.

Figure 7A:
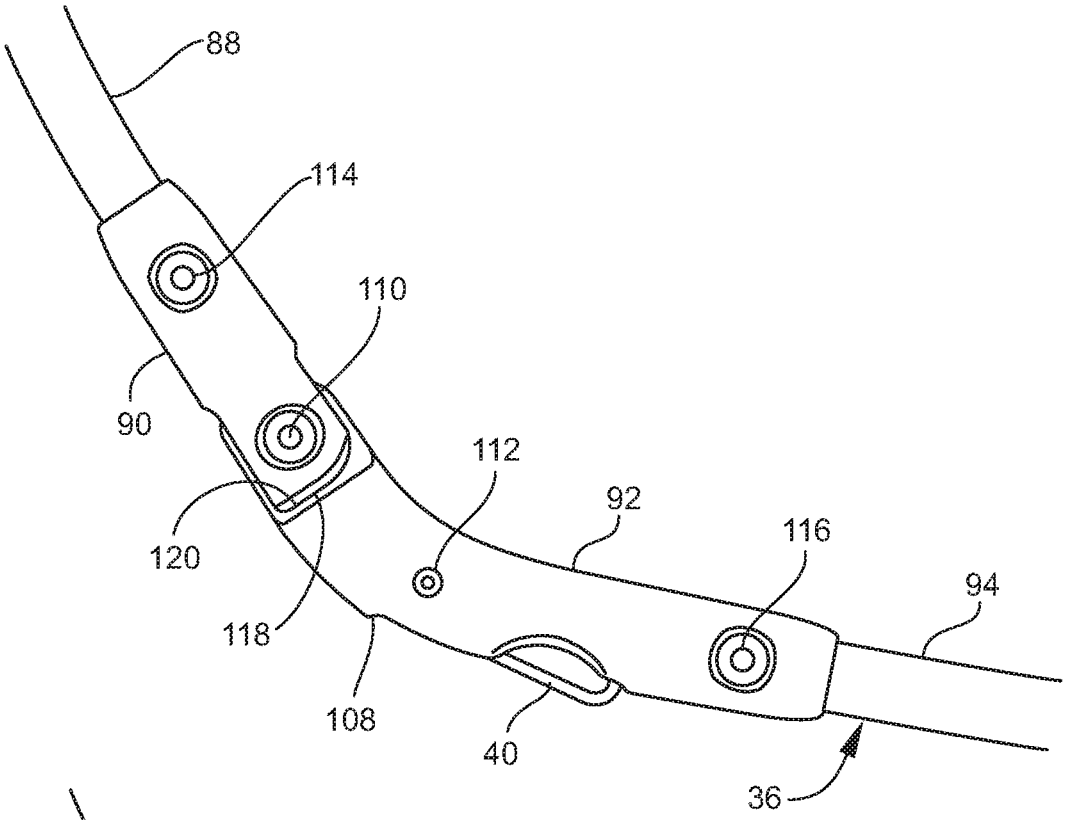
FIG. 7A is a detail perspective view of a portion of a rocker of the swivel rocker frame of FIG. 6A, showing the stop of the rocker retracted.
Figure 7B:
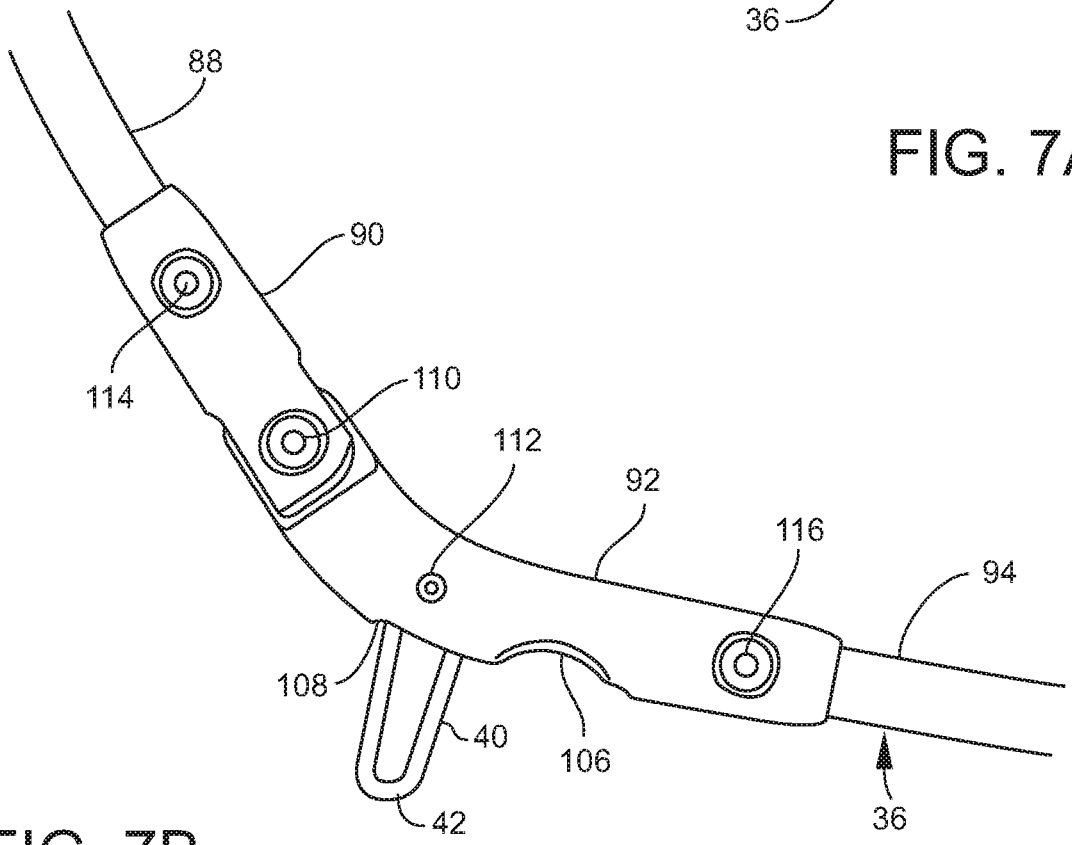
FIG. 7B is a detail perspective view of a portion of a rocker of the swivel rocker frame of FIG. 5A, showing the stop of the rocker extended.

FIGS. 7A and 7B show detail side views of the foot 40 retracted and extended, respectively. A pivot pin 112 engages the proximal end of foot 40 to receiver 92. A pin 114 fixedly engages the distal end of elongate tubular member 88 in receiver 90. A pin 116 fixedly engages an end of elongate tubular member 94 in receiver 92. In FIG. 7B, foot 40 is shown engaging slot end 108. FIGS. 7A and 7B show that to keep the elongate member 88 in the open position relative to elongate member 94 and so as to prevent a further downward pivoting of elongate tubular member 88, end surface 118 of receiver 88 may abut end surface 120 of receiver 92.

Figure 8A:
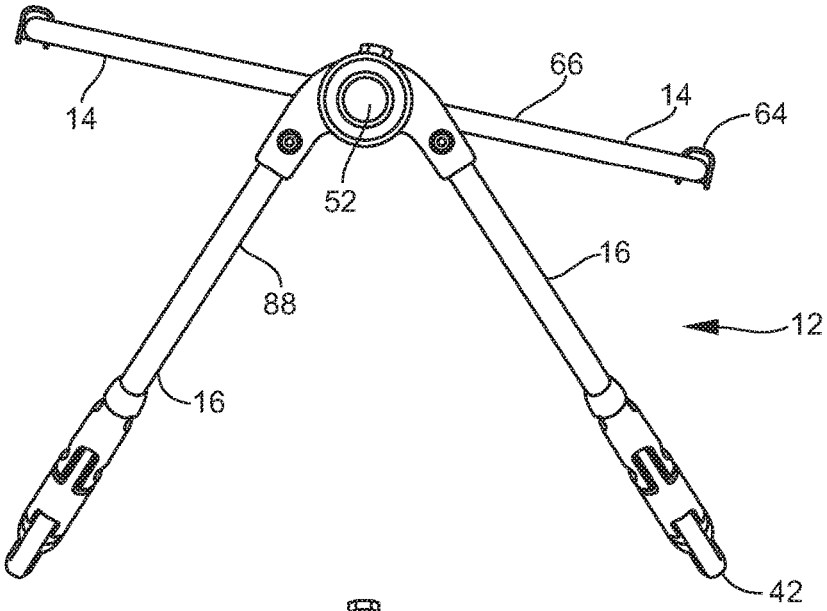
FIG. 8A is an end view of the swivel rocker frame of FIG. 5B, showing the swivel portion in an oblique position and having been swiveled in a first direction.
Figure 8B:
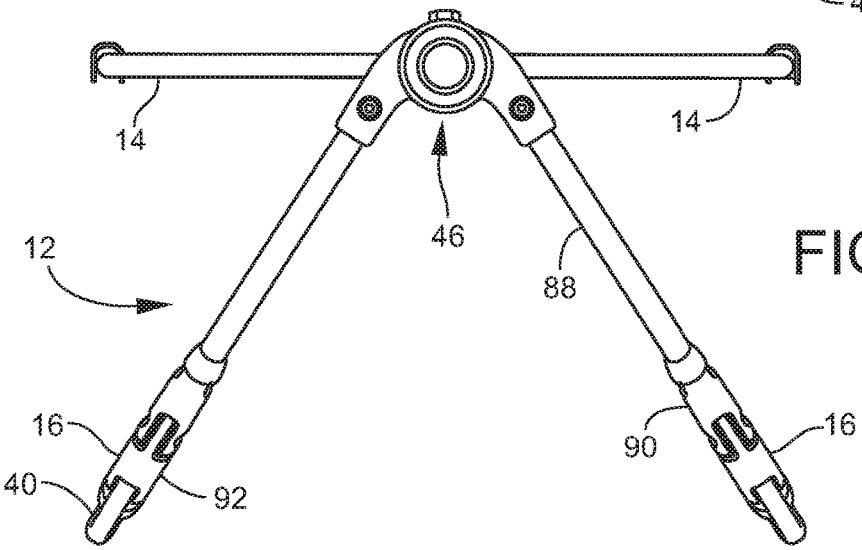
FIG. 8B is an end view of the swivel rocker frame of FIG. 8A, showing the swivel portion at a neutral horizontal position.
Figure 8C:
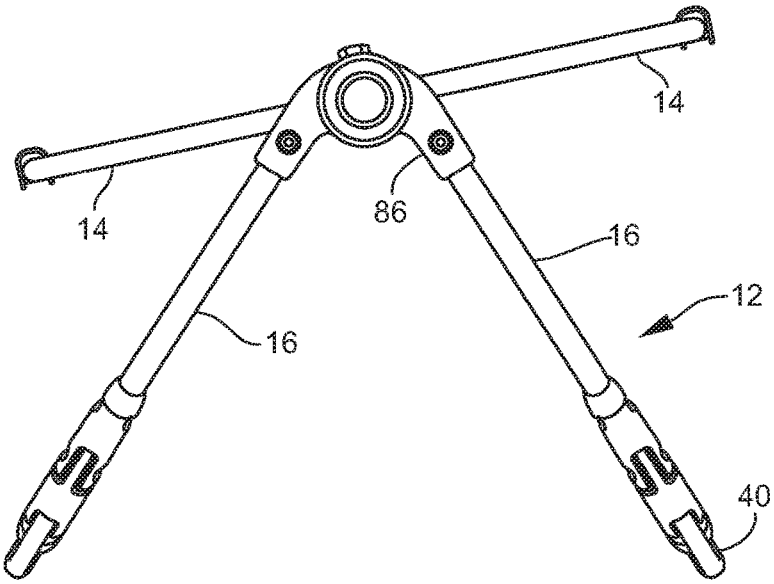
FIG. 8C is an end view of the swivel rocker frame of FIG. 8A, showing the swivel portion in an oblique position and having been swiveled in a second direction.

FIGS. 8A, 8B and 8C show the swiveling or roll action of the swivel frame portion 14. Swivel frame portion 14 may swivel to either side of the rocker frame portion 16 as shown in FIGS. 8A and 8C. Swivel frame portion 14 may be locked in a horizontal position as shown in FIG. 8B. The feet 40 are shown to be extended in FIGS. 8A, 8B and 8C.

The swiveling action can occur when the feet 40 are retracted. Swivel frame portion 14 can be locked in the horizontal position as shown in FIG. 8B whether the feet 40 are retracted or extended. Swivel frame portion 14 can swivel through the horizontal position shown in FIG. 8B.

Figure 9A:
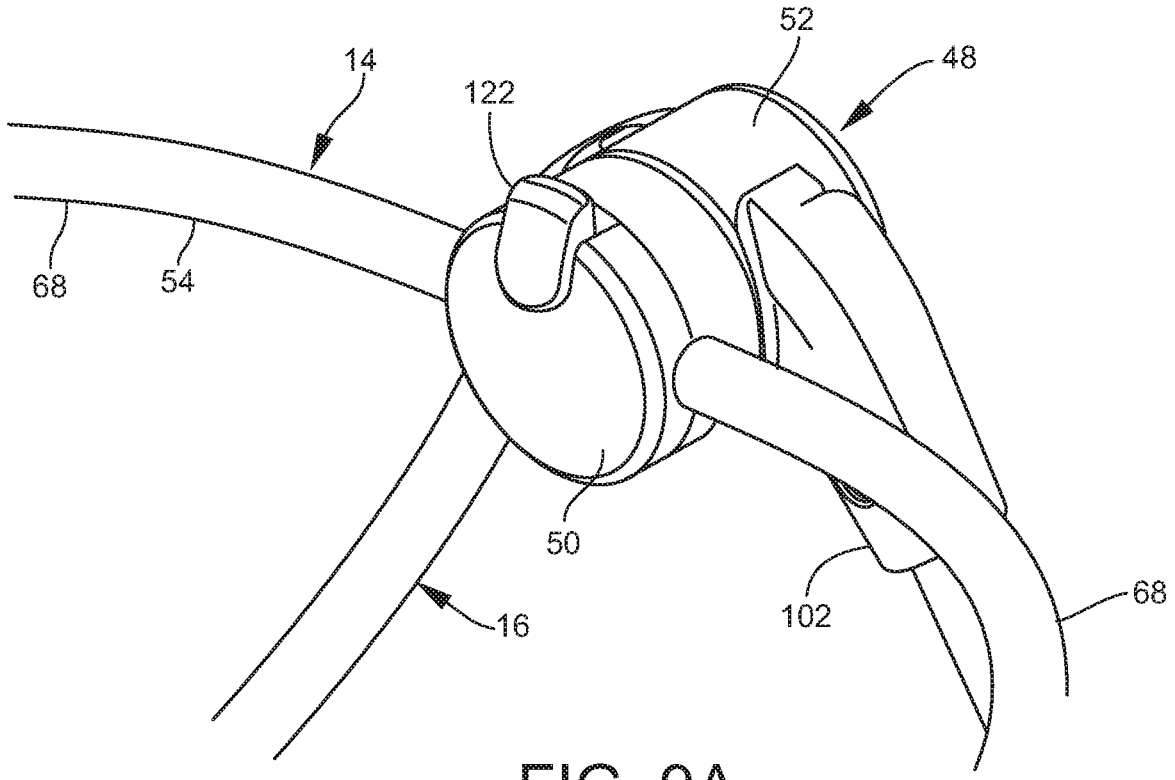
FIG. 9A is a perspective view of an unlocked position of a connection between the swivel portion and the rocker portion of the swivel rocker frame of FIG. 5B such that the swivel portion is permitted to swivel relative to the rocker portion.
Figure 9B:
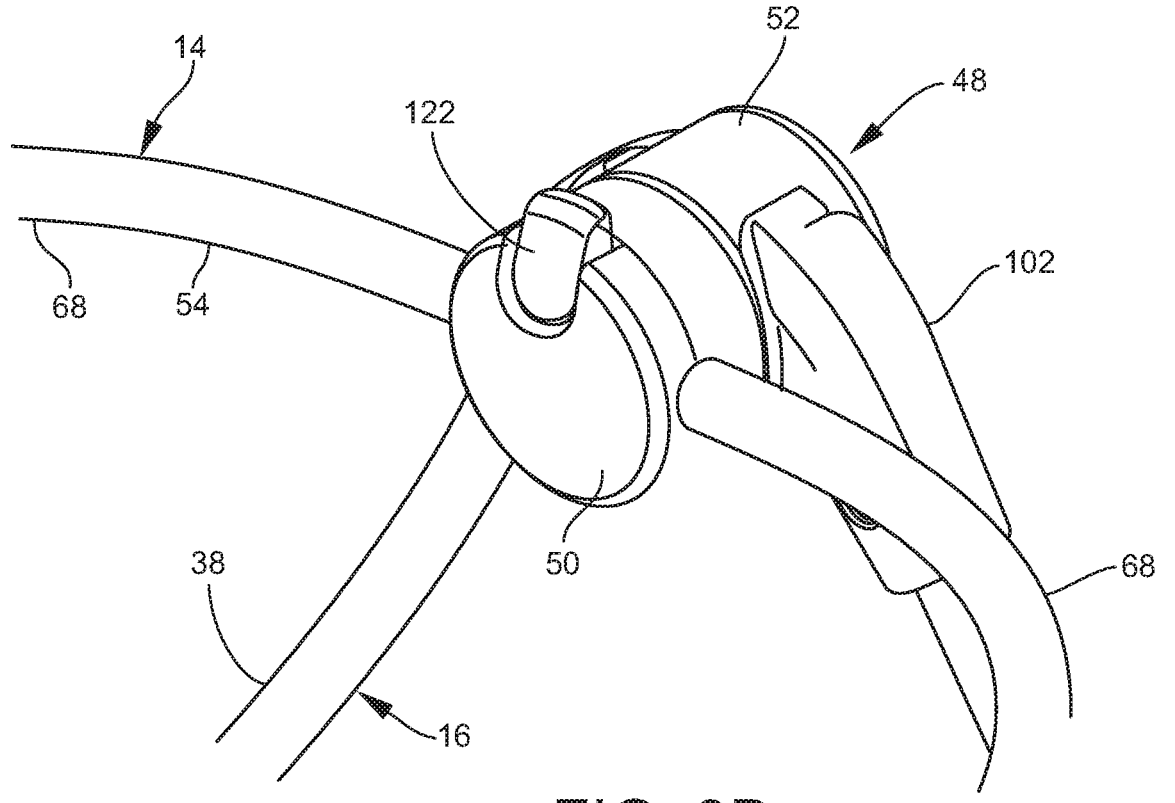
FIG. 9B is a perspective view of a locked position of the connection between the swivel portion and the rocker portion of FIG. 9B such that the swivel portion is locked against swiveling relative to the rocker portion.

FIG. 9A shows an unlocked position of the second connection hub 48 between the swivel frame portion 14 and the rocker frame portion 16 of the swivel rocker frame 12 such that the swivel frame portion 14 is permitted to swivel relative to the rocker frame portion 16. FIG. 9B shows a locked position of the second connection hub 48 between the swivel frame portion 14 and the rocker frame portion 16 such that the swivel frame portion 14 is locked against swiveling relative to the rocker frame portion 16. A button 122 on the swivel hub portion 50 is pressed in to lock the swivel hub portion 50 relative to the rocker hub portion 52 and to lock the swivel frame portion 14 again swiveling relative to the rocker frame portion 16.

Figure 11A:
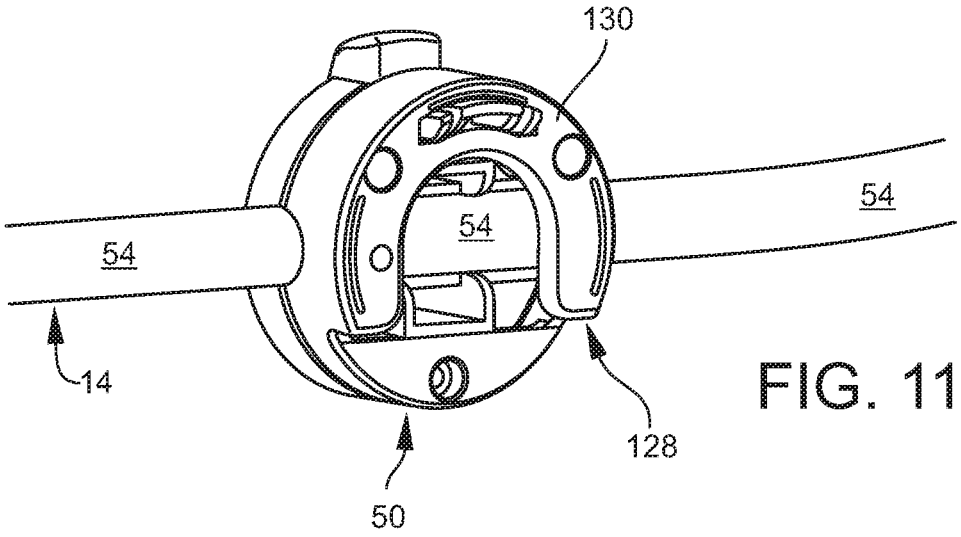
FIG. 11A is a perspective view of the connection of FIG. 9A, showing the rear side of the connection portion that is mounted on the swivel portion of the swivel rocker of FIG. 5B.

FIGS. 10A and 10B show the second connection hub 48 between the swivel frame portion 14 and rocker frame portion 16, and illustrate the swivel frame portion 14 and rocker frame portion 16 being engaged and disengaged to and from each other at the second connection hub 48. As shown in FIG. 10A, rocker hub portion 52 includes an inwardly extending cylindrical portion 124 and U-shaped or horseshoe shaped flange 126. U-shaped or horseshoe shaped flange 126 slides into a slot 128, shown in FIG. 11A, formed by a horseshoe or U-shaped structure 130 on the outer face 34 of the swivel hub portion 50.

Figure 12A:
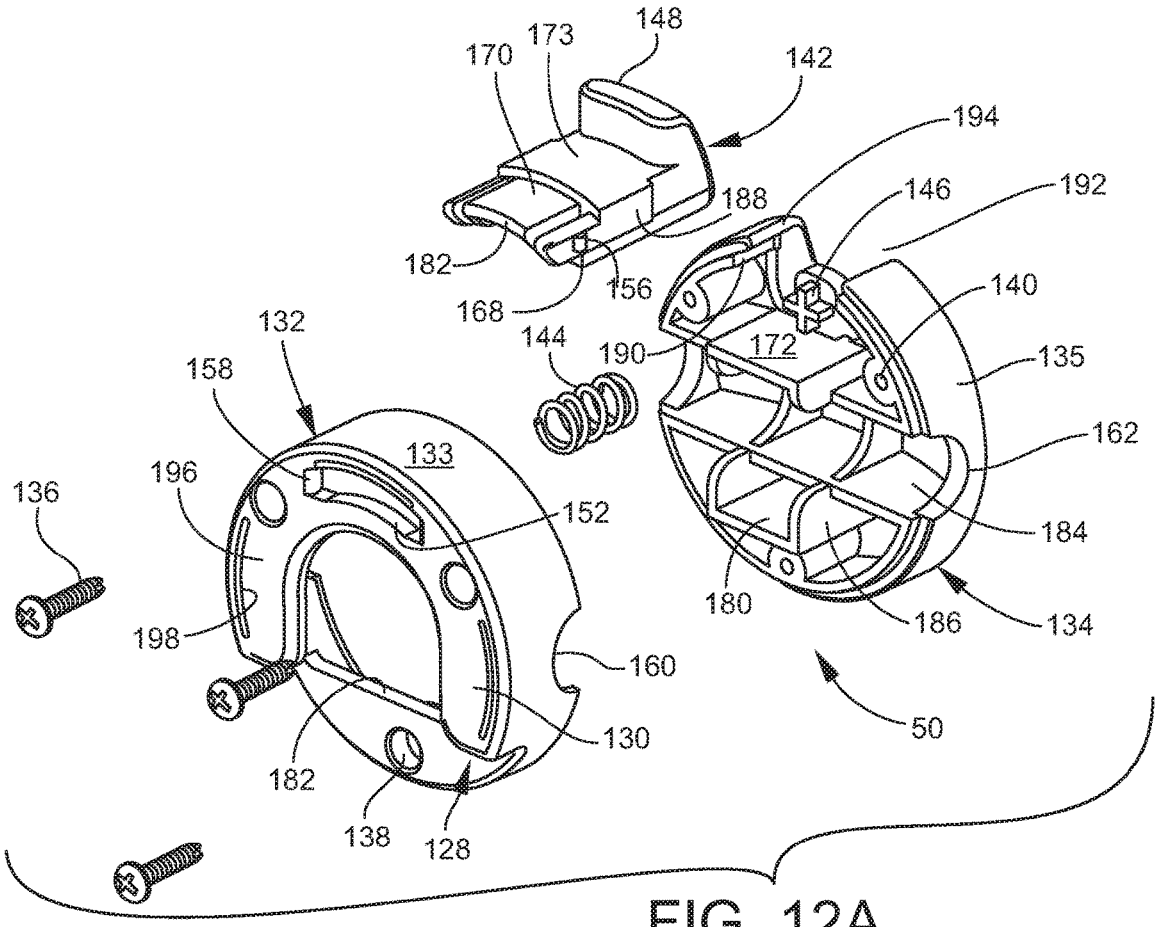
FIG. 12A is an exploded view of the connection portion of FIG. 11A that is mounted on the swivel portion of the swivel rocker of FIG. 5B.
Figure 12B:
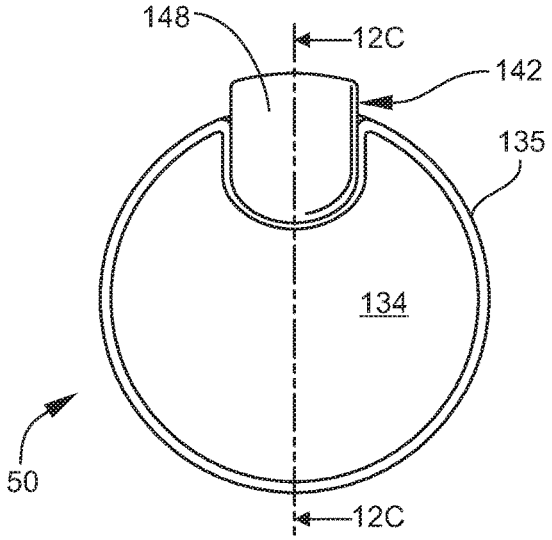
FIG. 12B is an isolated front end view of the connection portion of FIG. 11A that is mounted on the swivel portion of the swivel rocker of FIG. 5B.
Figure 12C:
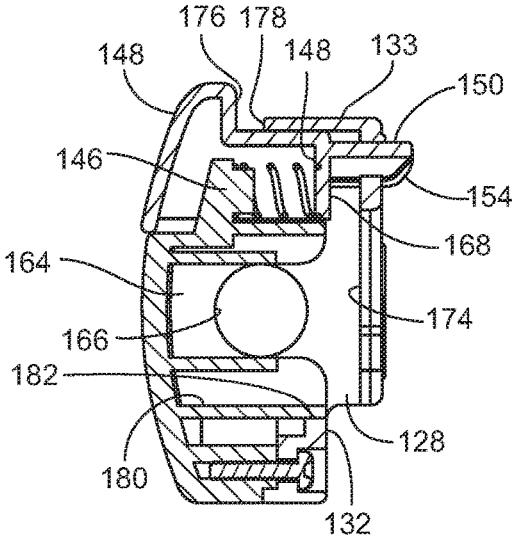
FIG. 12C is a section view at lines 12C-12C of FIG. 12B.

FIGS. 12A, 12B and 12C show the swivel hub portion 50. Swivel hub portion 50 includes a first body 132 having a cylindrical sidewall 133 and a second body 134 having a cylindrical sidewall 134. The first and second bodies 132, 134 are engaged to each other by pins 136, pin holes 138, and threaded pin receptors 140 such that the cylindrical sidewalls of the respective first and second bodies 132, 134 are aligned flush with each other. Prior to engaging the first and second bodies 132, 134 to each other, a push-pull tab apparatus 142 and coil spring 144 are engaged in and between the first and second bodies 132, 134. Coil spring 144 is engaged on a mount 146 and brings pressure to bear upon an interior vertical surface 148 of push-pull tab apparatus 144.

Push-pull tab apparatus 142 is generally L-shaped. Push-pull tab apparatus 142 includes a push-pull tab 148 extending transversely from a tongue 150. Tongue 150 extends through a curved slot 152 in first body 132. The distal end of tongue 150 includes an oblique or inclined surface 154. Tongue 150 further includes a pair of side mounted extensions or tongue stops 156 extending from side surfaces of the tongue 150. The tongue stops 156 abut slot end stops 158 at a first position where the swivel hub portion 50 is permitted to rotate relative to the rocker hub portion 52. The width that the tongue stops 156 provide to the tongue 150 is sufficiently large such that the force or push applied by coil spring 144 is insufficient to push the tongue stops 156 beyond the slot end stops 158. The width that the tongue stops 156 provide to the tongue 150 is sufficiently small such that the force provided by a finger can snappingly slide the tongue 150 beyond the slot end stops 158.

Each of the first and second bodies 132, 134 includes mounts for supporting the elongate tubular member 54. First body 132 includes a pair of circular mounts or recesses 160 formed in cylindrical sidewall 133. Second body 134 includes a pair of circular mounts or recesses 162 in cylindrical sidewall 135 and interior braces 164 having circular mounts or recesses 166. When the first and second bodies 132, 134 are engaged to each other, elongate tubular member 54 is engaged therein with some friction, yet the swivel hub portion 50 as a whole can spin on the elongate tubular member 54 such that, in the collapsed and folded form shown in FIG. 4B, the swivel axes of the swivel hub portions 50 are aligned with each other to maximize the flat form of such collapsed and folded form.

Tongue 150 includes a lock piece 168. Lock piece 168 is on the underside of the tongue 150. Lock piece 168 comes into play when the tongue stops 156 are forced beyond the end slot stops 158.

Tongue 150 takes a circular shape in section. The distal end 170 of tongue 150 also takes a circular shape or is curved from one side to the other side.

Lock piece 168 of tongue 150 slides on a horizontal platform 172. When tongue stops 156 meet end slot stops 158, the distal end of lock piece 168 stops just short of the upper space defined by slot 128. When tongue stops 156 are forced by and beyond end slot stops 158, the distal end of lock piece 168 moves into the upper space defined by slot 128 until the distal end of lock piece 168 hits the upper end of rear face 174 of U-shaped collar 130 and/or until a rear face 176 hits a front edge 178 of cylindrical sidewall 133 of first body 132.

Second body 134 includes a rearwardly extending panel 180 that rests upon an inner horizontal edge 182 of first body 132.

Push-pull tab apparatus 142 slides on horizontal platform 172 from below and includes a curved upper face 173 that rides against the inner face of cylindrical sidewall 133 from above. The width of the push-pull tab apparatus 142 is about the same or slightly less than the width of curved slot 152.

Tongue distal end 170 is set slightly below the curved upper face 173. Tongue distal end 170 includes an absolute end 182 that may hit an inside upper rear face 174 of U-shaped collar 130 to terminate the inward push of the push-pull tab apparatus 142 at about the same time as rear face 176 hits the front edge 178 of cylindrical sidewall 133.

Second body 134 includes a horizontally extending platform 184 that supports braces 164 and that support vertical panels 186 that in turn supports panel 180.

Tongue 150 includes wings 188 that ride upon second body edges 190. Cylindrical sidewall 135 of second body 134 includes an opening 192 for the push-pull tab apparatus 142. Sidewall edges 194 form the opening 192. Second body edges 190 are recessed circumferentially relative to sidewall edges 194 such that wings 188 ride inside of the sidewall 135.

First body 132 includes U-shaped collar 130 that in turn includes a rear face 196 that in turn includes circumferential extensions 198. The circumferential extensions 198 minimize riding surfaces and friction between the swivel hub portion 50 and the rocker hub portion 52. Circumferential extensions 198 slightly space the swivel hub portion 50 and the rocker hub portion 52 from each other.

Figure 13A:
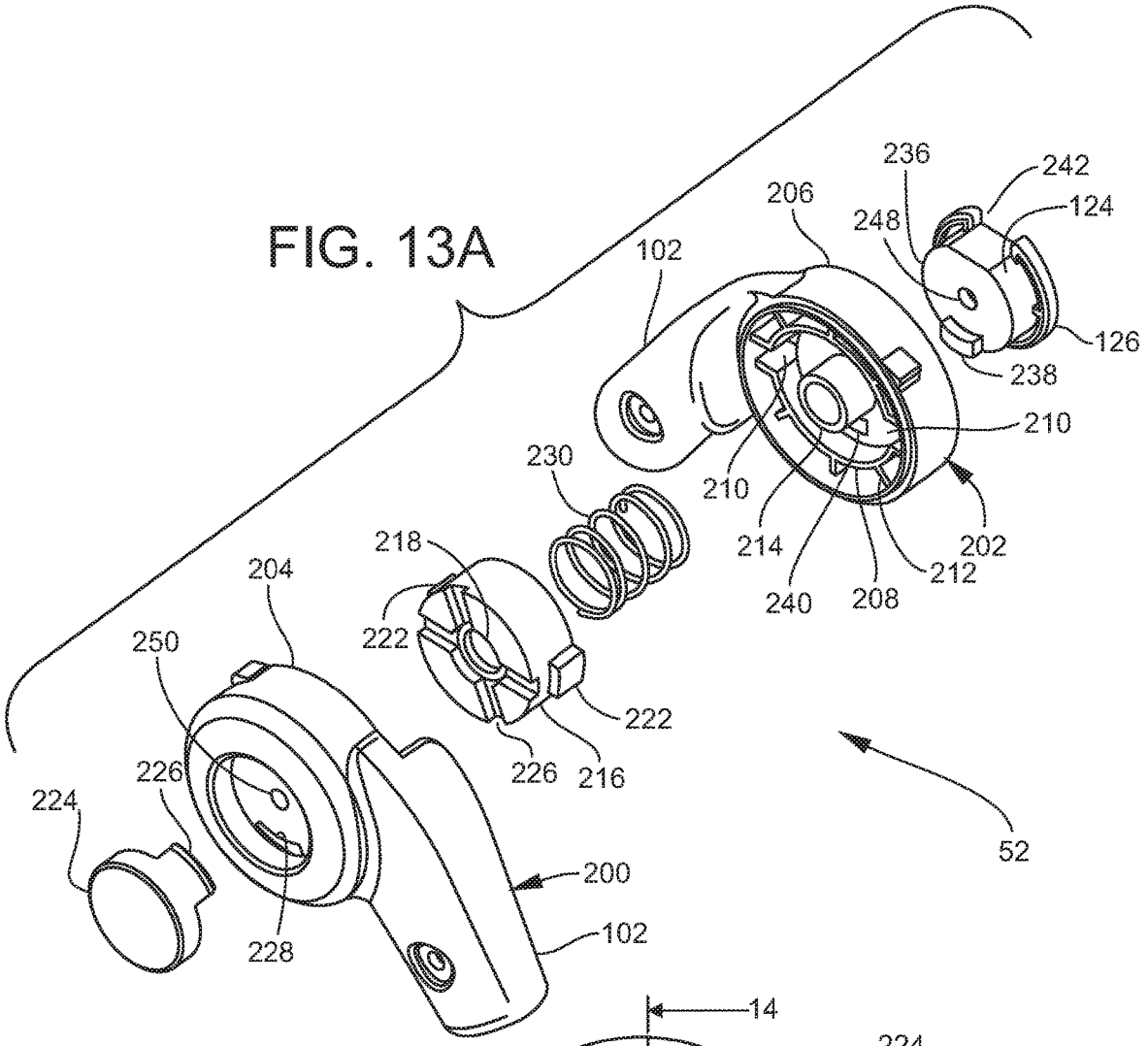
FIG. 13A is an exploded view of the connection portion of FIG. 11B that is mounted on the rocker portion of the swivel rocker of FIG. 5B.
Figure 13B:
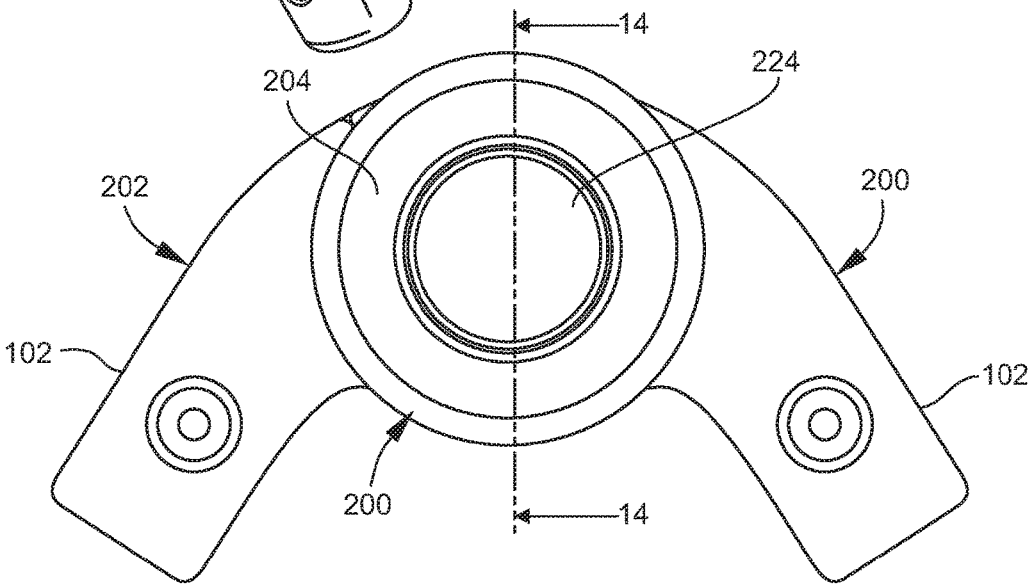
FIG. 13B is an isolated rear end view of the connection portion of FIG. 11B that is mounted on the rocker portion of the swivel rocker of FIG. 5B.
Figure 14:
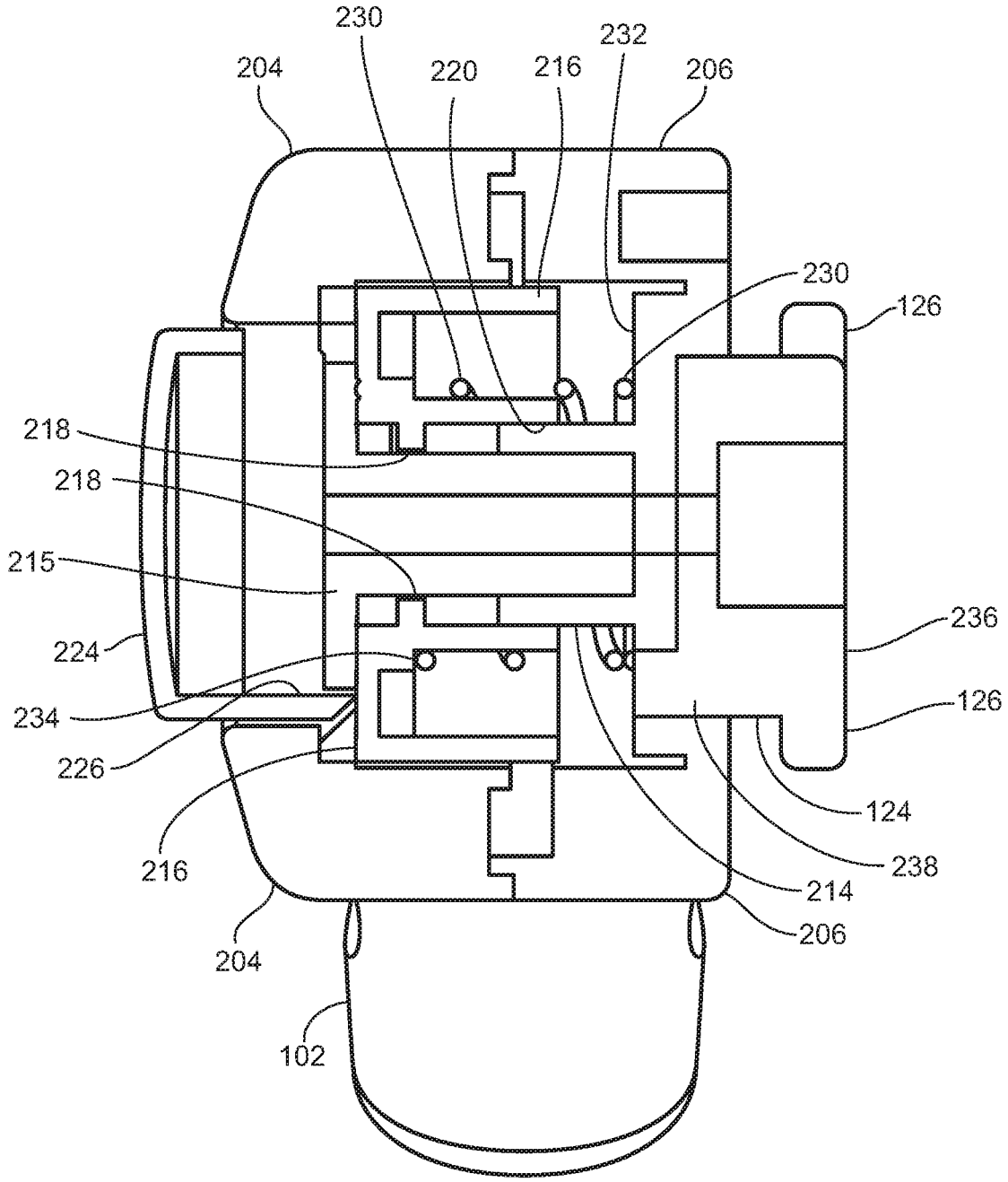
FIG. 14 is a section view at lines 14-14 of FIG. 13B.

As shown in FIG. 13A, rocker hub portion 52 includes a first body 200 and a second body 202. First body 200 includes a first receiver 102 and a cylindrical portion 204. Second body 202 includes a second receiver 102 and a cylindrical portion 206.

Cylindrical portion 206 includes an inner cylindrical wall 208. Inner cylindrical wall 208 includes diametrically opposite openings 210. Inner cylindrical wall 208 is spaced from the inner surface of cylindrical portion 206 by a plurality of radially extending braces 212. Cylindrical portion 206 includes a cylindrical axle 214 that is coaxial with the cylindrical portion 206 and the inner cylindrical wall 208.

Cylindrical portion 204 also includes an inner cylindrical wall having diametrically opposite openings, a plurality of radially extending braces, and a cylindrical axle 215. One difference is that the axle 215 of cylindrical portion 204 has a smaller diameter than the axle 214 of cylindrical portion 206 such that the axle 215 of cylindrical portion 204 slides coaxially inside of the axle 214 of cylindrical portion 206, thereby providing a rotational bearing between first and second bodies 200, 202.

Rocker hub portion 52 further includes a cylindrical lock piece 216. Lock piece 216 includes a first opening 218. First opening 218 rides on and is coaxial with the axle 215 of cylindrical portion 204. Lock piece 216 includes a second opening 220 that rides on and is coaxial with the axle 214 of cylindrical portion 206 such that lock piece 216 is rotatable on each of axles 214, 215.

Lock piece 216 includes diametrically opposite tab slides 222. Tab slides 222 slide in diametrically opposite openings 210 and further slide in the diametrically opposite openings of cylindrical portion 204. Tab slides 222 are always located in diametrically opposite openings 210. When lock piece 216 is depressed by button 224, lock piece 216 axially slides toward second body 202 and out of engagement with the diametrically opposite openings of cylindrical piece 204, thereby permitting the first and second bodies 200, 202 to rotate relative to each other. One tab slide 222 and one diametrically opposite opening 210 are larger than the other tab slide 222 and its respective diametrically opposite opening 210 such that during assembly the lock piece 216 is located correctly. The diametrically opposite openings of cylindrical body 204 also differ in size to uniquely match a respective tab slide 222. Lock piece 226 includes four slots 226 disposed obliquely to each other. Two of the four slots 226 receive a ridge in cylinder body 204 such that lock piece 216 is located correctly during assembly.

Button 224 includes a pair of diametrically opposed barbed arms 226 that extend through curved slots 228 in cylindrical portion 204. Button arms 226 bring pressure to bear upon lock piece 216 to slide lock piece 216 on cylindrical shafts 214, 215 and to slide lock piece 216 out of engagement with diametrically opposite openings of cylindrical piece 204.

Rocker hub portion 52 further includes coil spring 230. One end of coil spring 230 brings pressure to bear upon an inner surface 232 of cylindrical portion 206. The other end of coil spring 230 brings pressure to bear upon an inner surface 234 of lock piece 216 such that lock piece 216 is continuously biased in the direction of cylindrical portion 204. When lock piece 216 has been urged out of the diametrically opposed slots of cylindrical portion 204, proximal ends of the tab slide 222 ride upon the free edge of the inner cylindrical wall of the cylindrical portion 204 and pressure is imposed on such free edge by the proximal ends of the tab slide 222 by the coil spring 230. The free edge of the inner cylindrical wall 208 of cylindrical portion 206 is shown in FIG. 13A.

Rocker hub portion 52 further includes a mount 236. Mount 236 includes cylindrical portion 124 and U-shaped or horseshoe shaped flange 126. Mount 236 further includes locator tab 238 that engages tab opening 240 formed in a wall of cylindrical portion 206. Locator tab 238 places the U-shaped flange 126 in the correct position such that flange opening 242 is disposed correctly relative to the swivel hub portion 50.

Figure 11B:
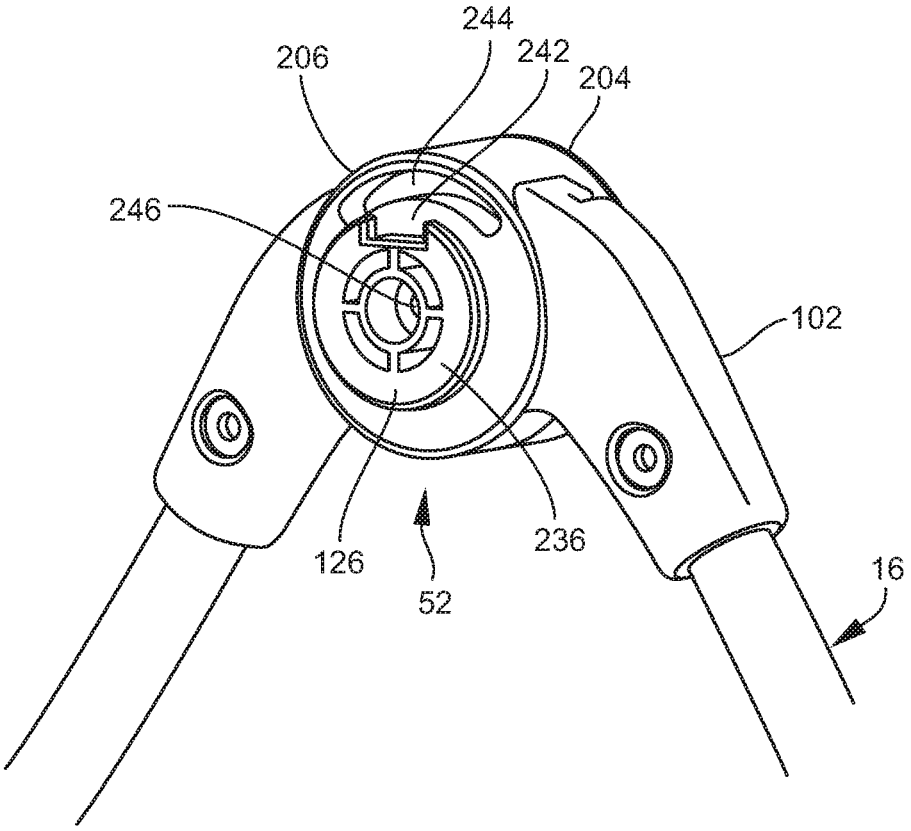
FIG. 11B is a perspective view of the connection of FIG. 9A, showing the front side of the connection portion that is mounted on the rocker portion of the swivel rocker of FIG. 5B.

FIG. 11B shows that mount 236 includes a curved recess or slot 244. Curved recess 244 receives the distal end 170 of the tongue 150. The ends of the curved recess or slot 244 work as stops to stop the rotational or swivel movement of the distal end 170 of the tongue 150 as the swivel hub portion 50 and thus the swivel frame portion 14 swivel or roll back and forth.

The flange opening 242 receives the lock piece 168 that is integral with the tongue 150. When the tongue stops 156 of the lock piece 168 are forced snappingly beyond the end slot stops 158 of first body 132 of swivel hub portion 50, lock piece 168 engages flange opening 242 to prevent rotation of the swivel hub portion 50 relative to the rocker hub portion 52 and thereby to prevent swiveling of the swivel frame portion 14. Terminal ends of the flange 126 work against the sides of the lock piece 168 to prevent rotation of the swivel hub portion 50 relative to the rocker hub portion 52.

An axial pin 246 holds first and second bodies 200 and 202 together, holds mount 236 on second body 202, and keeps lock piece 216 and spring 230 between the first and second bodies 200, 202. Axial pin 246 extends through axial opening 248 in mount 236 and axial opening 250 in first body 200. Barbs on button arms 226 keep button arms within slots 228.

When button 224 is pushed inwardly, the lock piece 216 is pushed out of engagement with first body 200, thereby permitting first and second bodies 200, 202 to rotate relative to each other, thereby permitting the rocker arms 36, 38 to be drawn inwardly to be adjacent to each other, as shown in FIG. 3B.

In operation, assembly of the swivel rocker 10 is started by gathering together the stand alone compact swivel frame portion 14 as shown in FIG. 4B, the stand alone compact rocker frame portion 16 as shown in FIG. 3A, and the stand alone baby receptacle 18. First, the U-shaped portions 66, 68 of the compact or folded swivel frame portion 14 are pivoted away from each other to define a plane as shown in FIG. 4A. Then the swivel hub portions 50 are rotated on the elongate member 54 such that the first and second outside faces 32, 34 face away from each other. Then the baby receptacle 18 is placed on the swivel frame portion 14 by inserting the elongate tubular member 54, now oblong in shape, into the U-shaped flap 73 that extends endlessly about the baby receptacle 18. Then the U-shaped flap 73 is buttoned down by buttons 75. Then the receivers 90 and 92 are unfolded relative to each other and the receivers 96 and 98 are unfolded relative to each other such that the rockers 36, 38 are full length. Then the rockers 36, 38 are drawn apart from each other until the coil spring 230 snaps the lock piece 216 back into the diametrically opposite openings of the first body 200, whereupon the rockers 36, 38 are locked in an open and operating position. Then the swivel frame portion 14 having the baby receptacle 18 thereon is brought down into engagement with the rocker frame portion 16 by engaging swivel hub portions 50 with rocker hub portions 52. The horseshoe shaped collar 130 of swivel hub portion 50 is slid down onto the flange 126 of rocker hub portion 52. The oblique or inclined absolute end 182 of the tongue 150 hits the outer sidewall of the cylindrical portion 206 of the rocker hub portion 52, which forces coil spring 144 into a compressive state, and, as the swivel hub portion 50 continues to engage the flange 126, the oblique or inclined absolute end 182 of tongue 150 is urged outwardly by the coil spring 144 and snaps into the curved recess 244 of the rocker hub portion 52. This draws to a close the assembly of the swivel rocker 10.

The swivel rocker 10 may be operated to swivel or roll a baby in the swivel rocker 10. The hands of a caregiver may gently press down on one of the sides of the swivel frame portion 14 to induce the swivel or roll motion, which motion is shown in FIG. 8A, 8B, or 8C. This swivel or roll motion may be induced with the legs 40 extended or with the legs 40 retracted. A swivel or roll to one side is terminated by a side of tongue 150 hitting one of the ends of the curved recess 244. The swivel rocker 10 may be locked to prevent such swivel or roll motion by fully pressing in button 122, as shown in FIG. 9B. When the button 122 is pressed in from the normal position, shown in FIG. 9A, tongue stops 156 are forced by or snapped by end slot stops 158 and tongue lock piece 168 is extended into flange opening 242, whereupon the sides of the tongue lock piece 168 confront the sides of the ends of the flange opening 242 such that swivel hub portion 50 is locked against rotation relative to the rocker hub portion 52. To place the swivel rocker 10 back into a swivel or roll mode, the button 122 is retracted to withdraw the lock piece 168 from the flange opening 242 and to draw the tongue stops 156 rearwardly immediately beyond the end slot stops 158 such that the flange 126 can again rotate within the collar 128.

The swivel rocker 10 may be operated to rock a baby in the swivel rocker 10. The rocking or pitch motion is induced by the caretaker gently placing a hand on one of the rocker ends 20, 22 and pushing downwardly. Swivel rocker 10 then rocks on the rockers 36, 38 with the legs 40 retracted. The swivel rocker 10 may be locked against such rocking by extending the legs 40.

The swivel rocker 10 may be operated to induce a yaw motion. Yaw is a rotation around a vertical axis. In other words, the swivel rocker 10 may have three axes like an airplane: roll, pitch and yaw. Roll is a motion around a horizontal axis, where the axis in this apparatus 10 is an axis intersecting the first and second ends 20, 22 of the rocker frame portion 16. Pitch is a motion around a horizontal axis, where the axis intersects the baby receptacle 18 in a sideways direction, and where the axis lies in a vertical plane intersecting hinge bodies 64 and location 44 on each of the rockers 36, 38. Yaw is a motion around a vertical axis, where the vertical axis can be any vertical axis intersecting the swivel rocker 10 anywhere. For example, with the legs 40 retracted, the swivel rocker 10 can be spun in a yaw motion where locations 44 may contact with a surface on which the swivel rocker 10 is being spun. With the legs 40 extended, the swivel rocker 10 may still be spun in a yaw motion.

The swivel rocker 10 may be operated to have all parts stationary. For example, the legs 40 may be extended to eliminate rocking on the rockers 36, 38 and the button 122 may be pressed to push lock piece 168 into flange opening 242 to eliminate swivel or roll motion, such that swivel rocker frame 12 is motionless.

The swivel rocker 10 may be operated to have the baby receptacle 18 move in the two motions of swivel (roll) and rock (pitch) at the same time. In other words, when the legs 40 are retracted and when the lock piece 168 is withdrawn from the flange opening 242, a caretaker may induce a swivel by pushing down on one side of the swivel frame portion 14 and induce a rock by pushing down on one of the ends 20, 22 of the rocker frame portion 14.

The swivel rocker 10 may also be operated to have the baby receptacle 18 move in the two motions of swivel (roll) and spin (yaw) at the same time.

The swivel rocker 10 may also be operated to have the baby receptacle 18 move in the two motions of rock (pitch) and spin (yaw) at the same time.

The swivel rocker 10 may also be operated to have the baby receptacle 18 move in the three motions of swivel (roll), rock (pitch) and spin (yaw) at the same time.

To disassemble the swivel rocker 10, the button 122 is slid back rearwardly to compress the coil spring 144 to draw the absolute end 182 of the tongue 150 out of the curved recess 244 of rocker hub portion 52 and generally flush with the outside face 32 (or 34) of the swivel hub portion 50, whereupon the horseshoe shaped collar 130 of the swivel hub portion 50 may be slidingly lifted of the flange 126 of the rocker hub portion 52, so as to separate the swivel frame portion 14 from the rocker frame portion 16. Then the button 224 of the rocker hub portion 52 is pressed to move the lock piece 216 out of the first body 200 such that the first body 200 and second body 202 may rotate relative to each other and draw in the rockers 36, 38 to be adjacent to each other, as shown in FIG. 3B. Then the receivers 90, 92 may be folded relative to each other and the receivers 96, 98 may be folded relative to each other to draw the first and second ends 20, 22 of the rocker frame portion into an adjacent relationship with each other. Then, if desired, the baby receptacle 18 may be removed from the swivel frame portion 14. Then, with or without baby receptacle 18 engaged thereto, the U-shaped portions 66, 68 of the swivel frame portion 14 may be folded to be adjacent to each other and the swivel hub portions 50 may be pivoted on elongate tubular member 54 so that the outside faces 32, 34 of the swivel hub portions 50 face away from each other and are disposed in the plane defined by its respective U-shaped portion 66, 68, as shown in FIG. 4B. It can be noted that in FIG. 4A, where the U-shaped portions 66, 68 lie in a common plane, each of the swivel hub portions 50 define a plane disposed at a right axis relative to the plane defined by the planar U-shaped portions 66, 68.

The ends of slot or curved recess 244 in combination with the tongue 150 provide a limit to the swivel motion. Slot or curved recess 244 is a swivel motion limiter.

The steps of setting up the rocker frame portion 16 must occur in the order shown in FIGS. 3A, 3B and 3C. In other words, in FIG. 3A the rocker frame portion 16 is folded twice with the ends 20, 22 adjacent to each other and with the elongate tubular member 54 extending outwardly from the ends 20, 22 and then extending inwardly back toward the ends 20, 22 such that rotation at the rocker hub portions 52 cannot occur without breaking the tongue 109 between receivers 90 and 92 and the other tongue 109 between receivers 96 and 98. Tongues 109 of rocker 36 define a plane with its respective rocker 36. Tongues 109 of rocker 38 defines a plane with its respective rocker 38. However, rotation at the rocker hub portions 52 can occur when the ends 20 and 22 are drawn outwardly, as shown in FIG. 3B, the once folded position. Thus, only when the rocker frame 16 attains the position of FIG. 3B can the rockers 36, 38 be drawn apart to further attain the position of FIG. 3C.

In the position of FIG. 3B, the flange opening 242 of one end 22 is not aligned with the flange opening 242 of end 20. This can be seen in FIG. 3B. In other words, all of the rocker hub portions 52 are manufactured to be identical such that when looking directly at the inside face of one rocker hub portion 52 when the rocker frame portion 16 is in the once folded position of FIG. 3B, flange opening 242 on end 22 is at about a two o'clock position and flange opening 242 on end 20 is at about a two o'clock position. In still other words, when looking at the inside face of rocker hub portion 52 on end 22, flange opening 242 will rotate counter-clockwise relatively when rocker frame portion 16 is drawn into the open position of FIG. 3C. Likewise, when looking at the inside face of rocker hub portion 52 on end 20, flange opening 242 will rotate counter-clockwise relatively when rocker frame portion 16 is drawn into the open position of FIG. 3C. Thus, when the rockers 36, 38 are drawn apart, and from one set perspective, the flange openings 242 of the ends 20, 22 will rotate toward alignment, with one flange opening 242 rotating counter-clockwise and with the other flange opening 242 rotating clockwise. In yet other words, the swivel frame portion 14 cannot be engaged to the rocker frame portion 16 when the rocker frame portion 16 is in the position of FIG. 3B, since one flange opening 242 is on the right side of the swivel axis and the other flange opening 242 is on the left side of the swivel axis. In fact, the swivel frame portion 14 cannot be engaged to the rocker frame portion 16 until the lock piece 216 snaps into back into the first body 200. At such a point, flange openings 242 are aligned, thereby allowing the connection between the swivel hub portion 50 and the rocker hub portion 52 only when the rocker frame portion 16 is locked in the open and operating position. Conversely, the rocker frame portion 16 cannot be folded from the open position of FIG. 3C to the once folded position of FIG. 3B until the swivel hub portion 50 is disengaged from the rocker hub portion 52 because the flange openings 242 cannot travel out of alignment to their respective right and left sides until the tongues 150 of the respective swivel hub portions 50 are removed from the flange openings 242.

Once the swivel frame portion 14 is removed, rocker frame portion 16 cannot be folded directly to the once folded position of FIG. 3A because of tongues 109. If such an attempt is made, tongues 109 may break or lose their integrity. However, by placing the plane of tongues 109 of rocker 36 generally parallel to the plane of the tongues 109 of rocker 38, as shown in FIG. 3B, the ends 20, 22 of the rocker frame portion 16 may be drawn in to the position shown in FIG. 3A.

A folding out of the rocker frame portion 16 must occur in the order of the positions shown in the sequence of FIG. 3A, then FIG. 3B, then FIG. 3C. Otherwise, the integrity of a portion of the swivel rocker 10 is compromised.

A folding in of the rocker frame portion 16 must occur in the order of the positions shown in the sequence of FIG. 3C, then FIG. 3B, then FIG. 3A. Otherwise, the integrity of a portion of the swivel rocker 10 is compromised.

It should be noted that the inner and outer sides 71, 73 of the baby receptacle 18 may have a rigid component, or formed from a plastic or polymer, or have some inverted U-shaped portion formed from a plastic or polymer, such that the baby receptacle 18 may hang on the elongate tubular member 54 with or without buttons 75 or another quick release connection. The U-shaped portions or flap 73 may have a locking or tension feature incorporated therein such that flap 73 may be snapped open and shut to capture the elongate tubular member 54.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A swivel rocker frame, comprising:

a) a rocker frame portion;

b) a swivel frame portion;

c) the rocker frame portion having first and second ends, each of the first and second ends of the rocker frame portion having an inside face, the first and second ends of the rocker frame defining a swivel axis;

d) the swivel frame portion having first and second ends, each of the first and second ends of the swivel frame portion having an outside face, the first and second ends of the swivel frame portion being on the swivel axis;

e) the swivel frame portion pivotally engagable to the rocker frame portion on the swivel axis in an open and operating position such that the inside face of the first end of the rocker frame portion confronts the outside face of the first end of the swivel frame portion and such that the inside face of the second end of the rocker frame portion confronts the outside face of the second end of the swivel frame portion;

f) the swivel frame portion being engagable to and disengagable from the rocker frame portion;

g) a baby receptacle engaged to and depending from the swivel frame portion, the baby receptacle comprising flexible material, the baby receptacle spaced from the rocker frame portion;

h) wherein, after being disengaged from the rocker frame portion, the swivel frame portion is foldable such that the first and second ends of the swivel frame portion confront each other;

i) wherein, when pivotally engaged to the rocker frame portion, the swivel frame portion defines a plane;

j) wherein, when disengaged from the rocker frame portion, the swivel frame portion is foldable to a U-shape;

k) wherein the swivel frame portion, to which the baby receptacle is engaged and from which the baby receptacle depends, defines said plane when pivotally engaged to the rocker frame portion, the swivel axis being in said plane, said plane being a flat plane and said swivel axis being a straight axis; and l) wherein the swivel frame portion includes first and second U-shaped portions, the first and second U-shaped portions being disposed in the flat plane.

2. The swivel rocker frame of claim 1, wherein after being disengaged from the swivel frame portion, the rocker frame portion is foldable such that the first and second ends of the rocker frame portion confront each other.

3. The swivel rocker frame of claim 1, wherein, when in the open and operating position, the rocker frame portion includes a first rocker and a second rocker, each of the rockers extending from the first end of the rocker frame portion to the second end of the rocker frame portion, each of the rockers being U-shaped.

4. The swivel rocker frame of claim 1, wherein, when in the open and operating position, the rocker frame portion includes a first rocker and a second rocker, each of the rockers extending from the first end of the rocker frame portion to the second end of the rocker frame portion, the first rocker defining a first plane, the second rocker defining a second plane, the first and second planes intersecting each other at an oblique angle.

5. The swivel rocker frame of claim 1, wherein, when disengaged from the swivel frame portion, the rocker frame portion includes a first rocker and a second rocker, the first and second rockers are pivotable to a position where the first and second rockers extend parallel to each other and are adjacent to each other.

6. The swivel rocker frame of claim 1, wherein, when disengaged from the swivel frame portion, the rocker frame portion includes a first rocker and a second rocker, the first and second rockers foldable to a position where the first end of the rocker frame portion confronts the second end of the rocker frame portion.

7. The swivel rocker frame of claim 1, and further including at least a first connection hub connecting the first end of the rocker frame portion to the first end of the swivel frame portion, the connection hub having a swivel hub portion and a rocker hub portion that are pivotally engaged to each other such that the swivel frame portion swivels relative to the rocker frame portion, wherein the swivel frame portion includes a tubular elongate member, and wherein the swivel hub portion engages the tubular elongate member such that when the tubular elongate member swivels about the first axis the swivel hub portion swivels too about the first axis, the swivel hub portion and the tubular elongate member swiveling relative to the rocker hub portion.

8. The swivel rocker frame of claim 1, and further including at least a first connection hub connecting the first end of the rocker frame portion to the first end of the swivel frame portion, the connection hub having a swivel hub portion and a rocker hub portion that are pivotally engaged to each other such that the swivel frame portion swivels relative to the rocker frame portion, wherein the swivel hub portion is slidingly engagable to and slidingly disengagable from the rocker hub portion to engage and disengage the swivel frame portion from the rocker frame portion.

9. The swivel rocker frame of claim 1, and further including at least a first connection hub connecting the first end of the rocker frame portion to the first end of the swivel frame portion, the connection hub having a swivel hub portion and a rocker hub portion that are pivotally engaged to each other such that the swivel frame portion swivels relative to the rocker frame portion, wherein the rocker frame portion includes a first rocker and a second rocker, the first and second rockers extending from the rocker hub portion and swingable to and away from each other about the swivel axis such that the first and second rockers are swingable to a first position where the first and second rockers are adjacent to each other and to a second position where the first and second rockers are spaced apart and in an open and operating position.

* * * * *